US010111572B2

(12) United States Patent
Miller et al.

(10) Patent No.: US 10,111,572 B2
(45) Date of Patent: Oct. 30, 2018

(54) PET HAIR REMOVAL APPARATUS

(71) Applicants: Nancy J. Miller, Spokane Valley, WA (US); Cheryl L. Adams, Cheney, WA (US)

(72) Inventors: Nancy J. Miller, Spokane Valley, WA (US); Cheryl L. Adams, Cheney, WA (US)

( * ) Notice: Subject to any disclaimer, the term of this patent is extended or adjusted under 35 U.S.C. 154(b) by 473 days.

(21) Appl. No.: 14/998,978

(22) Filed: Mar. 11, 2016

(65) Prior Publication Data

US 2016/0198921 A1 Jul. 14, 2016

Related U.S. Application Data

(63) Continuation-in-part of application No. 12/876,877, filed on Sep. 7, 2010.

(60) Provisional application No. 61/240,306, filed on Sep. 7, 2009.

(51) Int. Cl.

| | |
|---|---|
| ***A47L 13/16*** | (2006.01) |
| ***A47L 13/17*** | (2006.01) |
| ***B08B 1/00*** | (2006.01) |

(52) U.S. Cl.

CPC ..... *A47L 13/17* (2013.01); *B08B 1/00* (2013.01)

(58) Field of Classification Search

CPC ..... A47L 13/10; A47L 13/11; A47L 13/14; A47L 13/142; A47L 13/144; A47L 13/146; A47L 13/26; A47L 13/16; A47L 13/17; B08B 1/002

See application file for complete search history.

(56) References Cited

U.S. PATENT DOCUMENTS

| | | | | |
|---|---|---|---|---|
| 3,403,959 | A | 10/1968 | Holderman | 401/148 |
| 5,230,303 | A | 7/1993 | Rubino | |
| 6,698,626 | B2 | 3/2004 | McKay | |
| 7,186,207 | B2 | 3/2007 | McKay, Jr. et al. | |
| 7,350,257 | B2 | 4/2008 | McKay | |
| 7,377,001 | B2 | 5/2008 | McKay | |
| 7,559,108 | B2 | 7/2009 | Forte | |
| 7,647,890 | B1 | 1/2010 | Yananton | A01K 13/002 119/171 |
| 2003/0073602 | A1 | 4/2003 | Ramirez, Jr. | C11D 3/0026 510/421 |
| 2007/0061986 | A1 | 3/2007 | Huntington | A47L 13/18 15/227 |
| 2007/0181167 | A1 | 8/2007 | Muradov | 134/42 |
| 2007/0292195 | A1 | 12/2007 | May et al. | 401/134 |

*Primary Examiner* — Mikhail Kornakov
*Assistant Examiner* — Ryan L Coleman
(74) *Attorney, Agent, or Firm* — Reidlaw, LLC; John S. Reid

(57) ABSTRACT

A cleaning apparatus includes a fluid reservoir assembly and a removable cleaning pad cartridge assembly. The reservoir assembly includes a reservoir body defining a closed fluid reservoir, a pump device, and at least one outlet valve which allows fluid to exit the reservoir when the reservoir is pressurized by the pump device. The cartridge assembly includes a cleaning pad support body, a cleaning pad support base, and a cleaning pad defined by an outer edge area. The support body and base are immovably joined together. The support body includes a downward-projecting outer lip, and the support base includes an upward-projecting outer flange. The outer lip of the support body is inward of the outer flange of the support base, and the outer edge area of the cleaning pad is between the outer lip of the support body and the outer flange of the support base.

20 Claims, 20 Drawing Sheets

10
11
20
22
23
26
28
18
14
16
12

PET HAIR REMOVAL APPARATUS

CROSS REFERENCE TO RELATED APPLICATIONS

This application claims priority to, and is a continuation-in-part of, U.S. patent application Ser. No. 12/876,877, filed on Sep. 7, 2010, which in turn claims priority to U.S. Provisional Patent Application Ser. No. 61/240,309, filed on Sep. 8, 2009. The entirety of the foregoing applications are hereby incorporated by reference herein. Priority to the above-referenced patent applications is hereby claimed under one or more of 35 U.S.C. §§ 119, 120, and/or 121.

BACKGROUND

The accumulation of pet hair is a common problem for pet owners and those who have pets visiting their home. Individuals purchase many products to assist them in removing hair from their furniture and carpet but many of these products are inefficient and expensive to purchase. One product historically used for removing pet hair is the vacuum cleaner. The vacuum cleaner is expensive and has a tendency to miss some of the hair trapped on the furniture. Other devices use adhesive tapes or rollers that quickly fill with hair and must be replaced often. Some products currently on the market cause a portion of the pet hair that is being collected to be expelled from the furniture or carpet into the surrounding air.

While the prior art is replete with a number of different devices that can be used for the removal of pet hair and the like from articles such as clothing and upholstered furniture, these prior art devices exhibit certain limitations. In some instances the devices are integral, such that when the cleaning surface of the device becomes soiled, damaged or worn, the device must be disposed of, and replaced, in its entirety. One example of such an integral device is provided for in U.S. Pat. App. Pub. No. 2007/0292195 A1, which in FIG. 15 thereof provides for a cleaning pad (390) which is integrally incorporated with a fluid reservoir body 312, such that the cleaning pad cannot be separated from, and thus separately replaced with respect to, the fluid reservoir body once the cleaning pad loses its effectiveness. Another example of such a device that must be replaced in its entirety when the cleaning surface loses (or becomes diminished in) its effectiveness to remove hair or the like from a surface to be cleaned is the "Magik Brush" lint brush provided by Butler Home Products, LLC of Marlborough, Mass. (US). The "Magik Brush" includes directionally-oriented fibers that collect hair and/or lint from a surface to be cleaned when moved across the surface in a particular direction. When the directionally-oriented fibers of the "Magik Brush" become worn or fouled, the ability of the device to remove hair or lint from a surface becomes diminished, and the device thus must be replaced in its entirety, as the device does not allow for replacing the directionally-oriented fibers separately from the rest of the device. (It will also be noted that "Magik Brush" device, as well as other prior-art devices, requires directional application of the cleaning surface across the surface to be cleaned.) In other instances the prior-art devices provide for a support body that is configured to receive replaceable cleaning pads. One example of such a device is the "Scotch™ Fur Fighter™ Hair Remover for Upholstery" by 3M Corporation (of St. Paul, Minn., US). Another example of the latter type of device is the Scotch Lint Roller offered by 3M Corporation (of St. Paul, Minn., US). These devices generally require the user to accurately position and tension replacement cleaning sheets or pads onto a support body, which can present a challenge to the user. Improper placement of replacement cleaning sheets or pads to a support body can result in reduced effectiveness of the device, and potentially cause harm or damage to the surface to be cleaned. The present disclosure provides for an apparatus which overcomes these deficiencies in prior-art pet hair and lint removal apparatuses.

BRIEF DESCRIPTION OF THE DRAWINGS

FIG. 4 is a cross sectional view of an illustrative multi-layered absorbent pad according to an embodiment.

FIG. 9 is a cross sectional view of an illustrative multi-layered absorbent pad according to an embodiment.

FIG. 10 is an illustrative method for filling an apparatus according to an embodiment.

FIG. 13 is an illustrative method for swiping the apparatus across material to clean and/or gather hair according to an embodiment.

DETAILED DESCRIPTION

Figure 1:
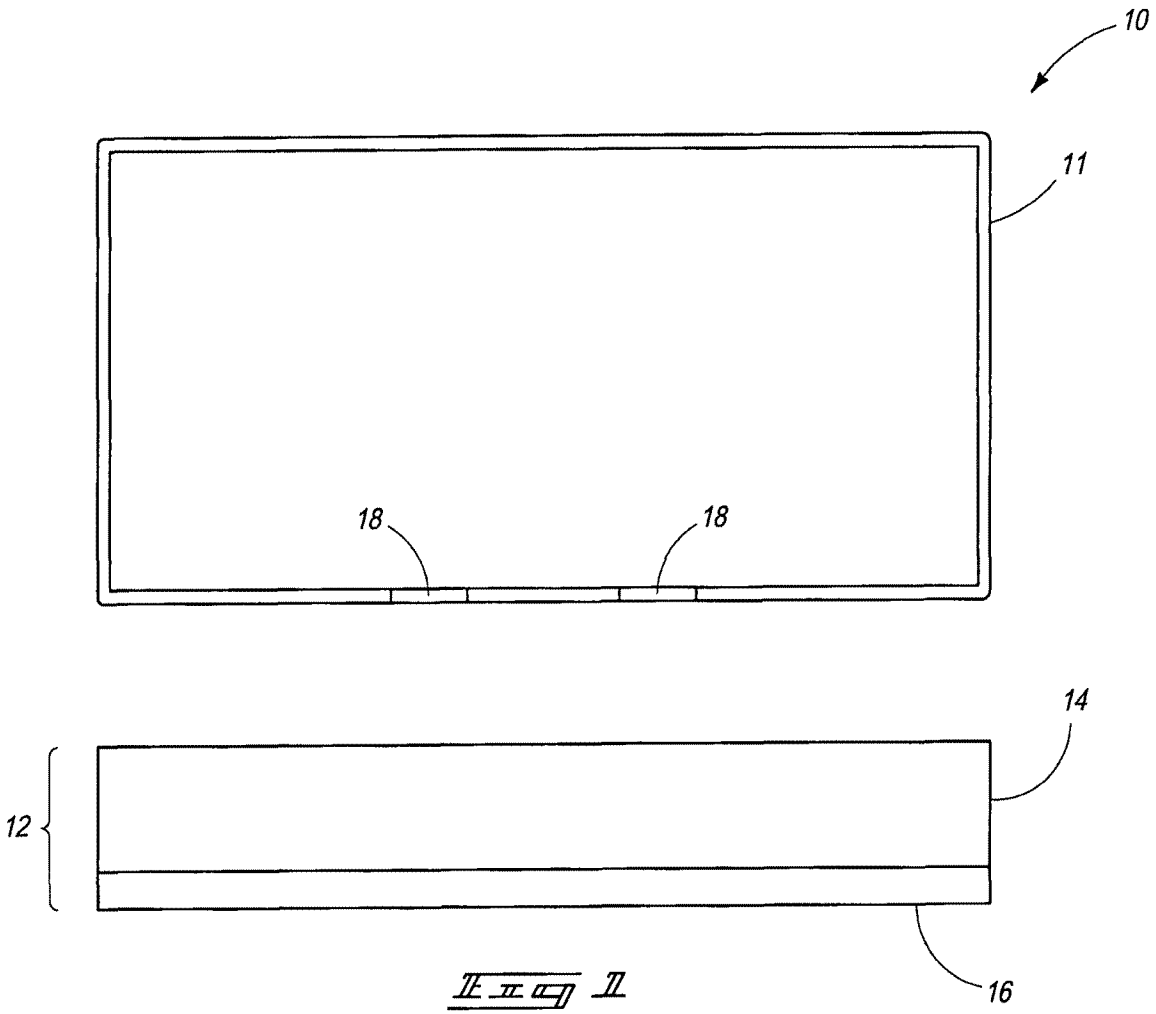
FIG. 1 is a cross sectional view of an illustrative reservoir and multi-layered absorbent pad according to an embodiment.

The apparatuses of the present disclosure are described with reference to FIGS. 1-23E. Referring first to FIG. 1, apparatus 10 is shown that includes component 11 and can be configured as a reservoir capable of receiving, storing, and dispersing liquids. Apparatus 10 can also include component 12 that can be configured as a multi-layered absorbent pad. Component 12 can comprise at least two layers, component 14 and component 16. According to example embodiments, component 14 can be configured as a substantially rigid material and component 16 can be configured as a less rigid material than component 14. Either or both of components 14 and 16 can be comprised of an absorbent polymeric material. Component 11 can be comprised of a rigid, translucent polymeric material that can be resistant to degradation by organic chemicals. Additionally, component 11 can be configured as a handle that provides support for component 12 when the apparatus is used for cleaning and/or hair gathering. According to example embodiments, any and all components of apparatus 10 can also be described as elements or members.

Figure 2:
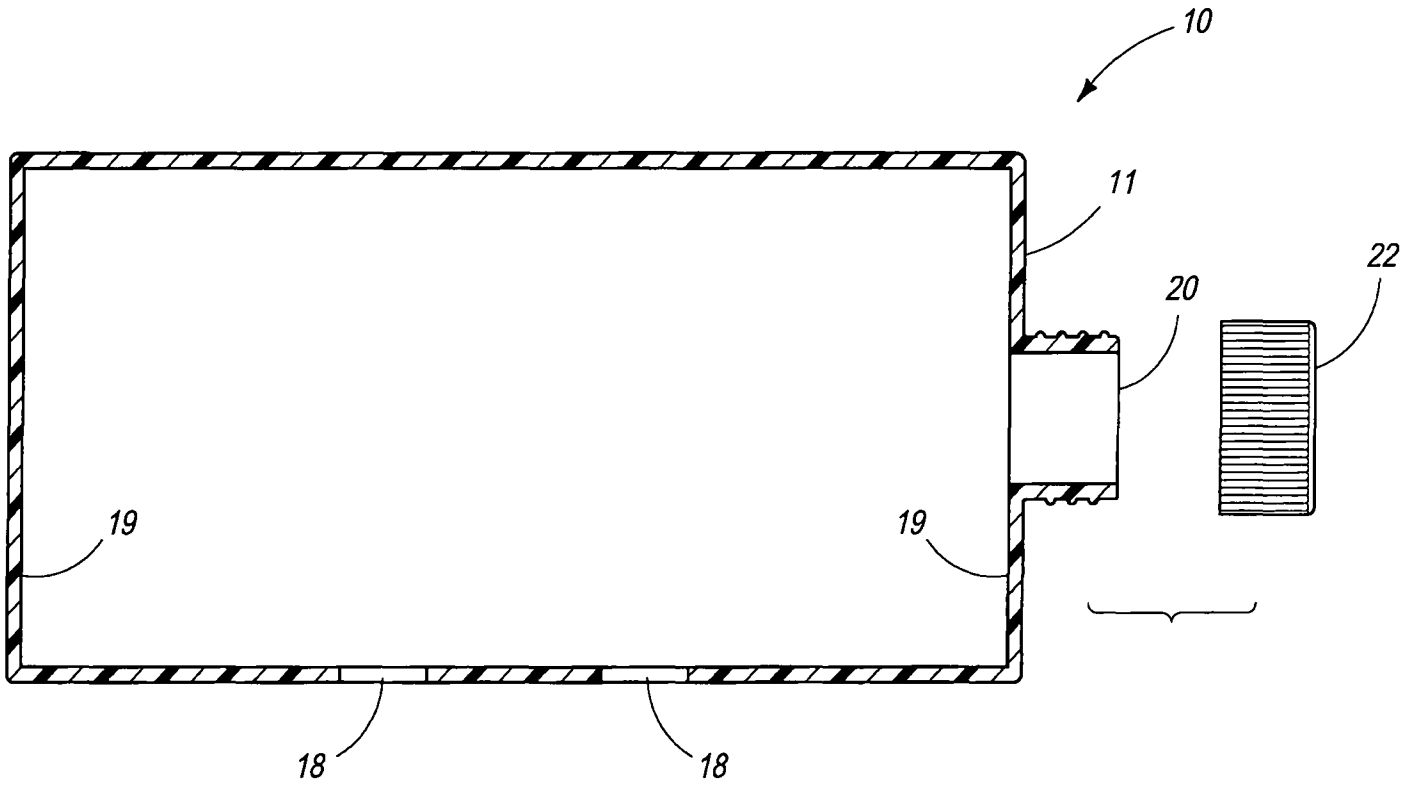
FIG. 2 is a cross sectional view of an illustrative reservoir with an opening and a cap according to an embodiment.

Referring next to FIG. 2, according to another implementation, apparatus 10 is shown, including component 11. According to an example embodiment, component 11 can include lateral walls 19. At least one of the lateral walls 19 can define opening 20 capable of receiving liquids. Opening 20 can be configured as a threaded female joint that can receive a cap. According to example implementations, component 11 of apparatus 10 can also include component 22 that can be configured as a cap to seal opening 20.

Figure 3:
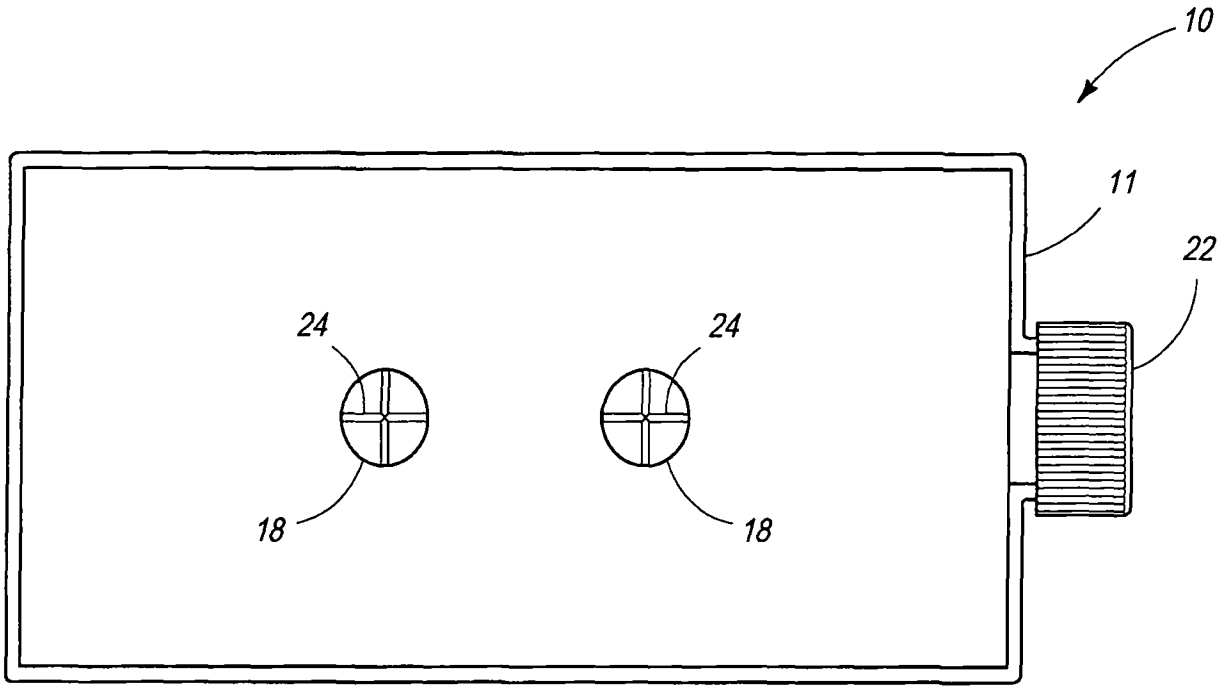
FIG. 3 is another view of an illustrative reservoir with one-way-opening slits according to an embodiment.

Referring next to FIG. 3, the underside of component 11 is shown including openings 18. In accordance with example implementations, openings 18 can be configured as a multi-channeled exit port having one-way-opening slits 24 that can at least partially open. Slits 24 can be comprised of a substantially flexible material that opens when adequate pressure is applied to within component 11, allowing liquid from within the reservoir to exit from the reservoir until pressure equilibrates.

Referring next to FIG. 4, component 12 is shown that includes components 14 and 16. According to example implementations, component 14 can be configured as a substantially rigid, and/or highly porous material. Also according to example implementations, component 16 can be configured as a less rigid, and/or less porous material than that of component 14. Component 14 can be configured to receive liquid from component 11 and disperse that liquid throughout a majority of component 14. According to example implementations, component 14 can also disperse liquid from component 11 to component 16, allowing a majority of component 16 to receive the liquid. Component 14 can also be configured to have a greater rate of absorption than that of component 16, allowing liquid to pass freely through component 14 and into component 16. The lesser rate of adsorption of component 16 can allow liquid to be retained within component 16 until adequate pressure is applied to component 16. According to example implementations, the interface between component 14 and component 16 can be intermingled so that components 14 and 16 are not separate and distinct layers.

Components 14 and 16 can also be compressible and/or permeable. Component 16 can be configured to compress at a rate greater than that of component 14. The greater compressibility of component 16 can allow retained liquid from within component 16 to be released with less pressure than that of component 14. Both components 14 and 16 may be configured to compress under pressure and expand when pressure is released. According to example implementations, component 16 can be configured to compress under less pressure than that of component 14.

Figure 5:
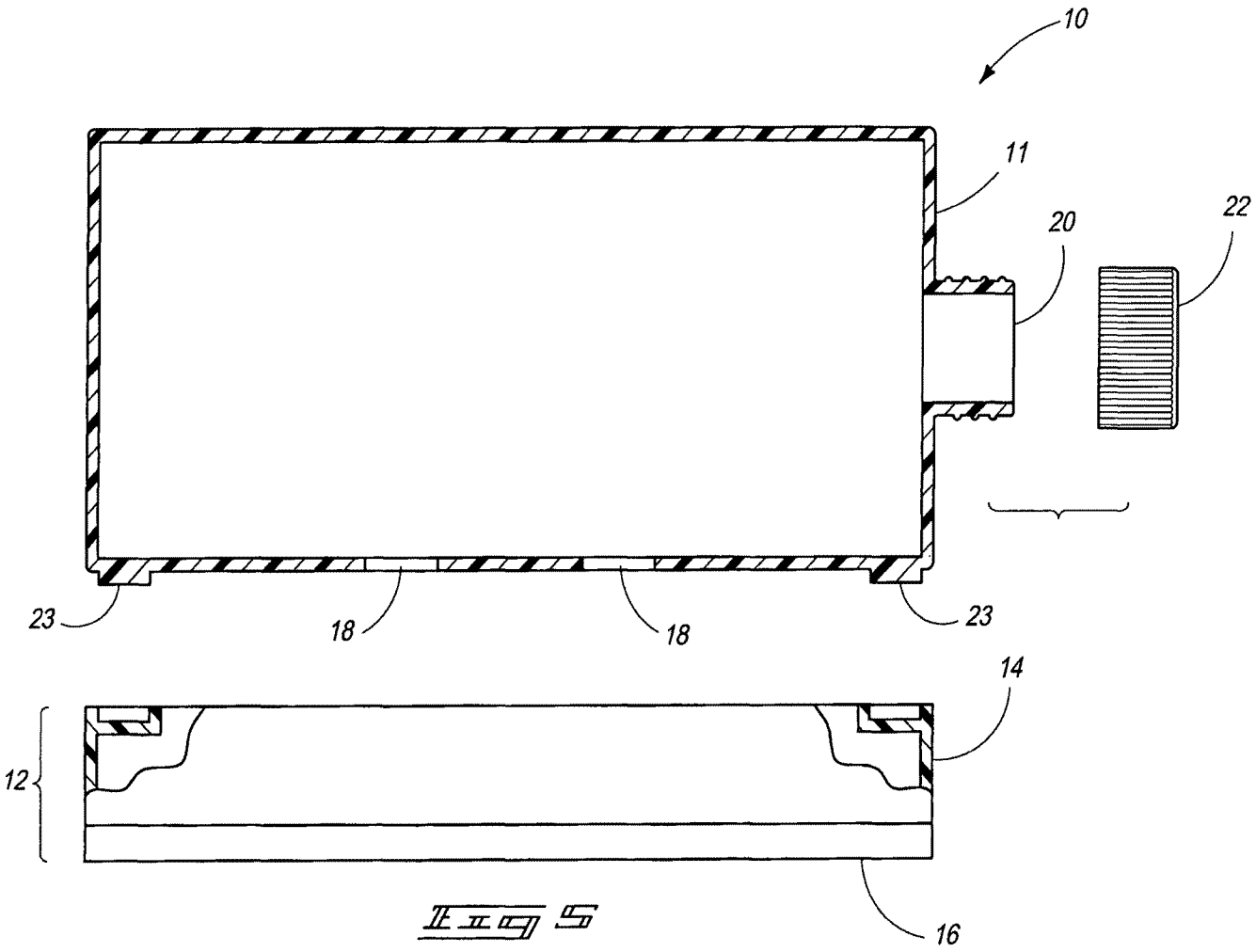
FIG. 5 is a cross sectional view of an illustrative reservoir and a cross sectional view of an illustrative multi-layered absorbent pad according to an embodiment.

Referring next to FIG. 5, apparatus 10 is shown as well as component 12. Component 11 can include components 23 that can be configured as a plurality of members extending outwardly from the surface defining openings 18 to the reservoir, which can be received by component 12. Components 23 can provide a mechanism for attachment of component 11 to component 12. Components 23 can also be configured to release component 11 from component 12, allowing either component to be replaced as needed.

Figures 6, 6A, 7:
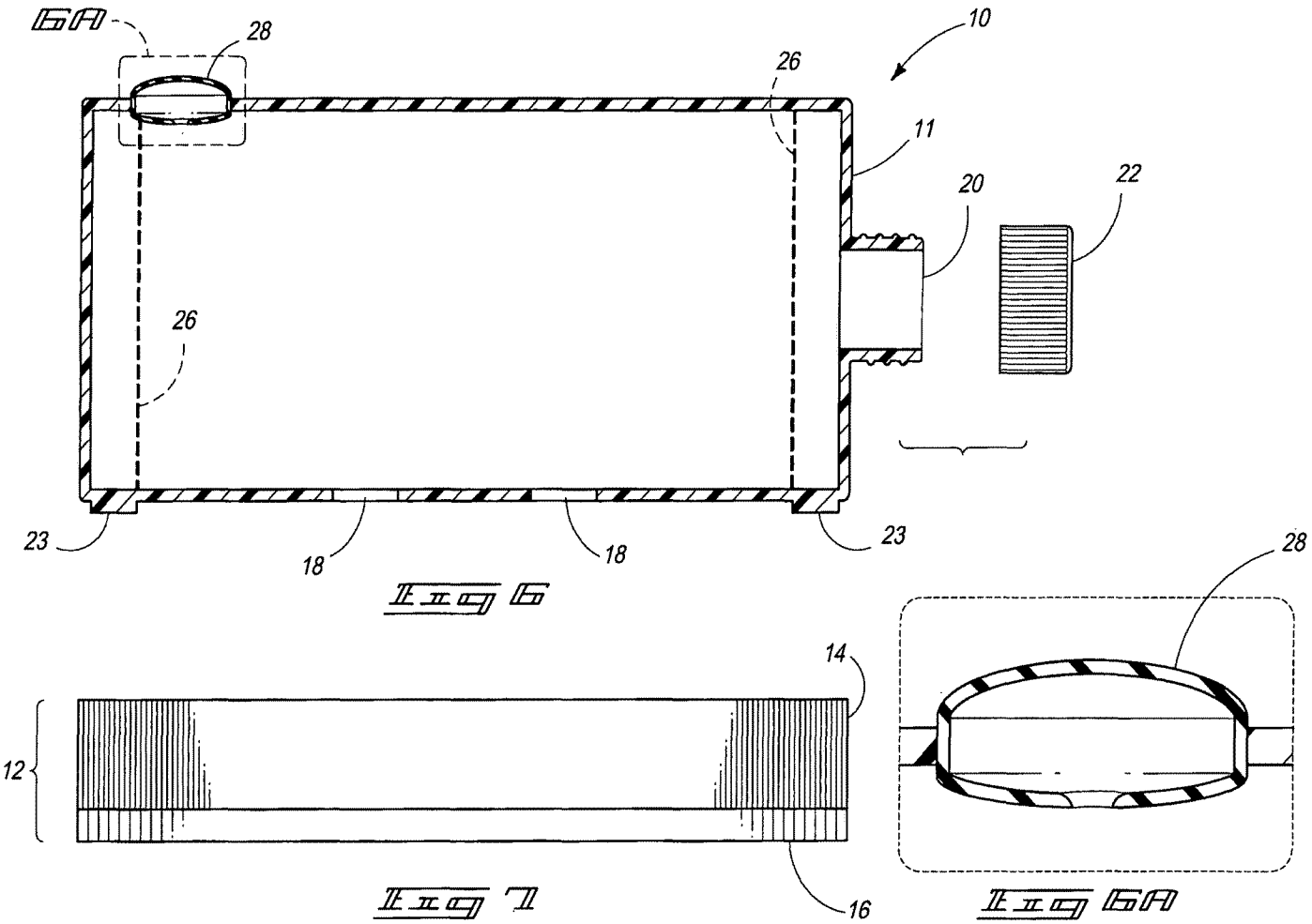
FIG. 6 is a cross sectional view of an illustrative reservoir with a flexible biased member and demarcations according to an embodiment.
FIG. 6A is a magnified cross sectional view of an illustrative flexible biased member according to an embodiment.
FIG. 7 is a cross sectional view of an illustrative multi-layered absorbent pad according to an embodiment.

Referring next to FIG. 6, component 11 is shown that can include at least one demarcation 26 and one flexible biased member 28. According to example embodiments, demarcations 26 can be visually observable from outside of component 11. Demarcations 26 can be utilized during the filling procedure of apparatus 10 to provide a method of measuring cleaning solution and water and/or other liquid to within component 11, the cleaning solution and water and/or other liquid being combined to provide an aqueous cleaning solution.

According to example embodiments, flexible biased member 28 can be configured to provide a pressure differential within component 11 when forced to an anti-biased position. Flexible biased member 28 can be forced to an anti-biased position by applying force to at least a portion of the member. When pressure is released, flexible biased member 28 can return to its original biased position and relieve pressure from within component 11. According to an example embodiment, flexible biased member 28 can be located laterally of a centerline of component 11 in one cross section. The location of flexible biased member 28 can diminish the likelihood of accidental force being applied to flexible biased member 28 when component 11 is used as a handle.

Figure 8:
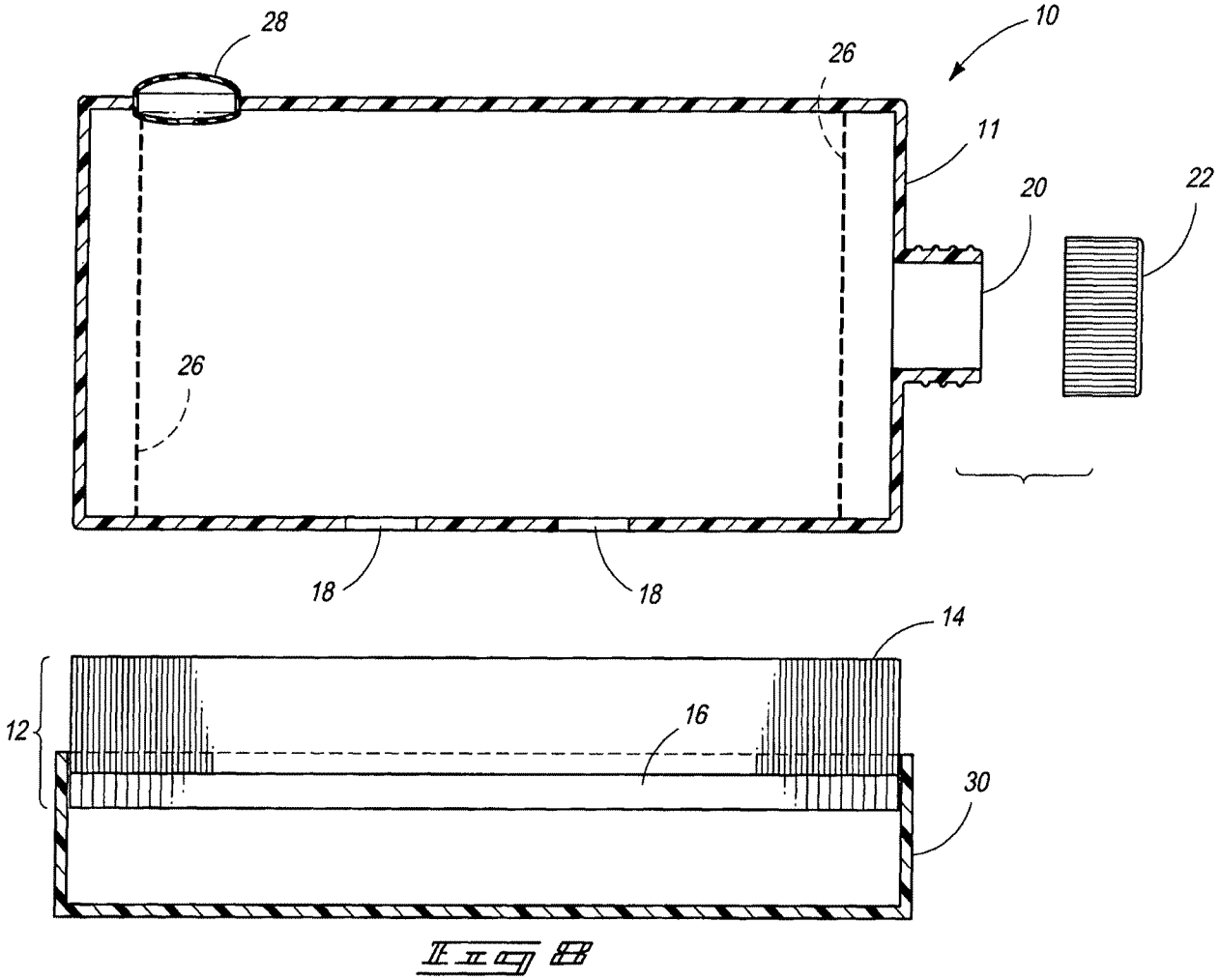
FIG. 8 is a cross sectional view of an illustrative reservoir and multi-layered absorbent pad with a cross sectional view of an illustrative holding vessel according to an embodiment.
Figure 6:
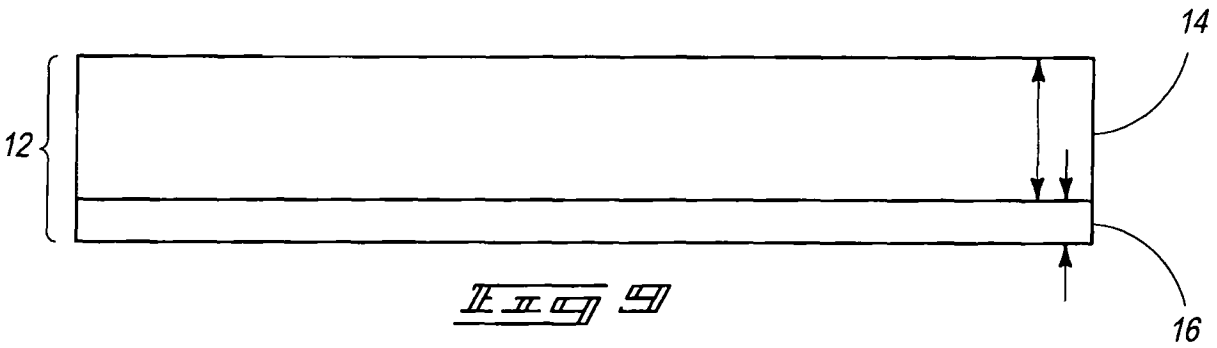
Figure 11:
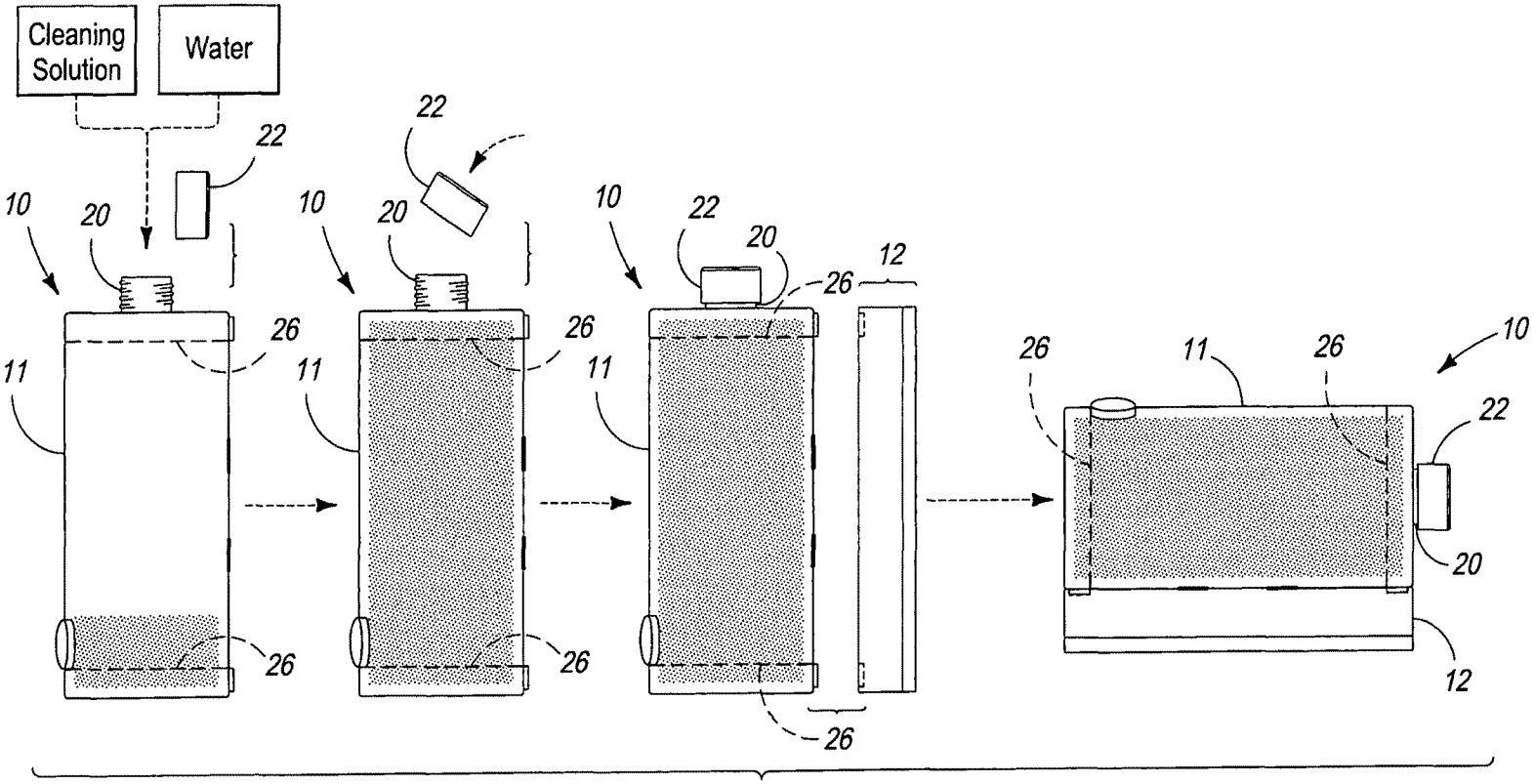
Figure 11:
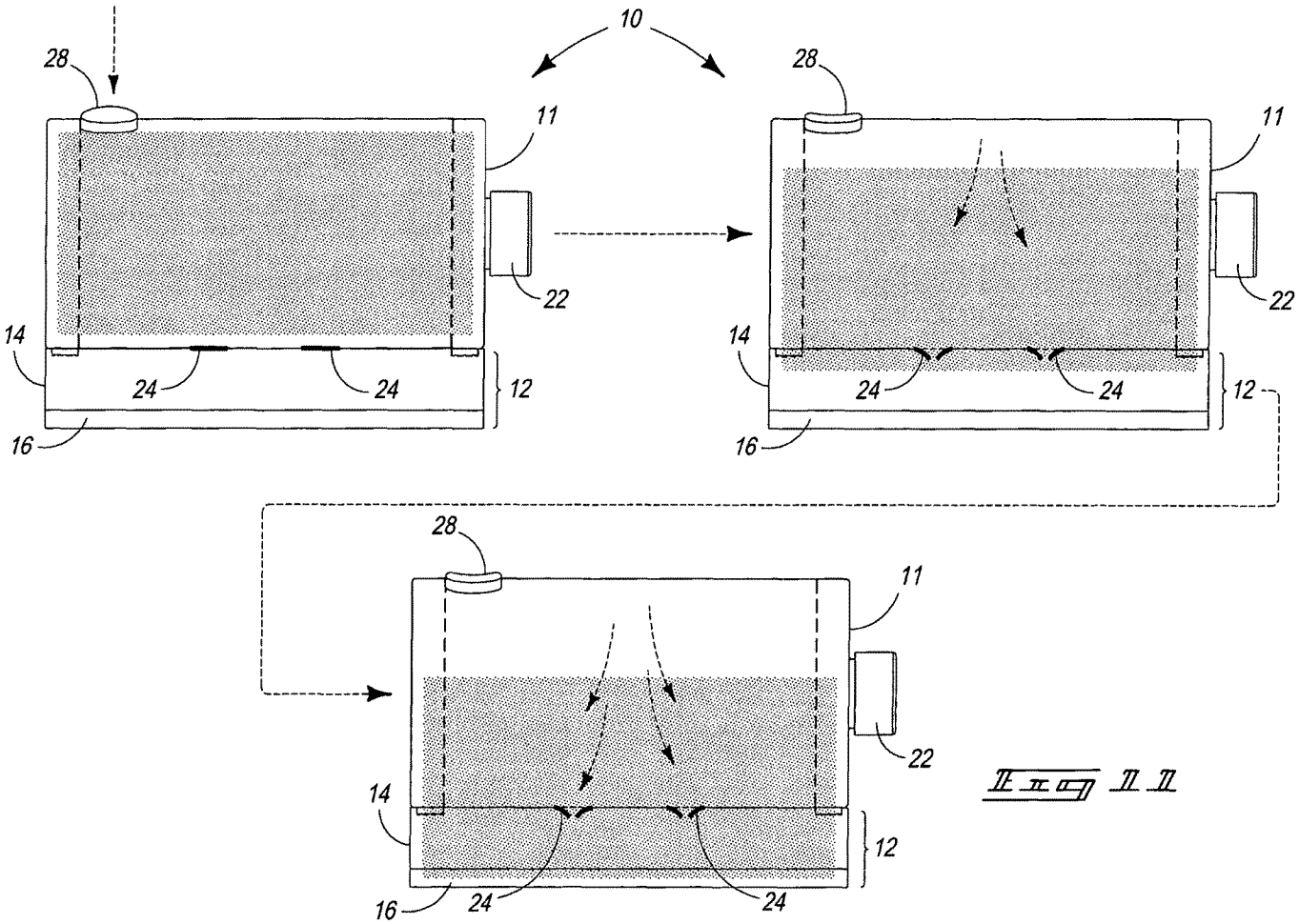

Referring next to FIG. 8, component 11 and component 12 are shown. Also shown is component 30 that can be configured as a vessel to receive at least a portion of component 12 and/or component 11. Component 30 can be defined as an open box that can hold liquids and can keep component 12 from drying for some time. Additionally, component 30 can be implemented as a storage device to protect component 11 and/or component 12 from drying out or from potential environmental wear and tear. Keeping component 12 from drying can allow component 12 to be used quickly when needed for cleaning and/or hair gathering. Additionally, component 30 can prevent unused liquids from within component 12 from evaporating, thus diminishing the possibility of wasting aqueous cleaning solution.

Referring next to FIG. 9, an embodiment of component 12 is shown that can include components 14 and 16. According to an example embodiment, component 14 can be configured to be at least twice the thickness of component 16 in one cross section. The greater thickness of component 14 can provide a sturdier base for component 16 when the latter is swiped across furniture and other materials during cleaning. The thickness of both component 14 and 16 can allow liquid to be absorbed and retained within each component. Component 16 can also expand when adequate liquid is provided and can retract when external pressure is applied. Both component 14 and 16 may be compressible, but component 14 can be configured to be less compressible than component 16 to provide a more solid base for component 16.

Referring next to FIG. 10, methods for the filling procedure of apparatus 10 are shown. According to example implementations, apparatus 10 can be placed upon one of its lateral walls with opening 20 facing upward. Aqueous cleaning solutions can be received by component 11, using the visual demarcations 26 to facilitate a proper ratio of cleaning solvent to water and/or other liquid. Once a desired amount of aqueous cleaning solution has been added to component 11, cap 22 can be placed over opening 20 to substantially seal opening 20. Component 12 can then be attached to component 11. Apparatus 10 can then be rotated so that component 12 becomes the base of the apparatus and component 11 sits on top of component 12. The aqueous cleaning solution within component 11 can remain inside the reservoir until cleaning and/or hair gathering is desired.

As an alternative to using an aqueous cleaning solution as the cleaning solution to be received with component 11, other liquids can also be used. For example, some stains react more readily with more polar organic solvents such as ethanol. Component 11 can be configured to be chemically resistant to a wide range of chemical polarities and chemical make-ups to receive and store such chemicals within the reservoir for a period of time.

Figure 11:
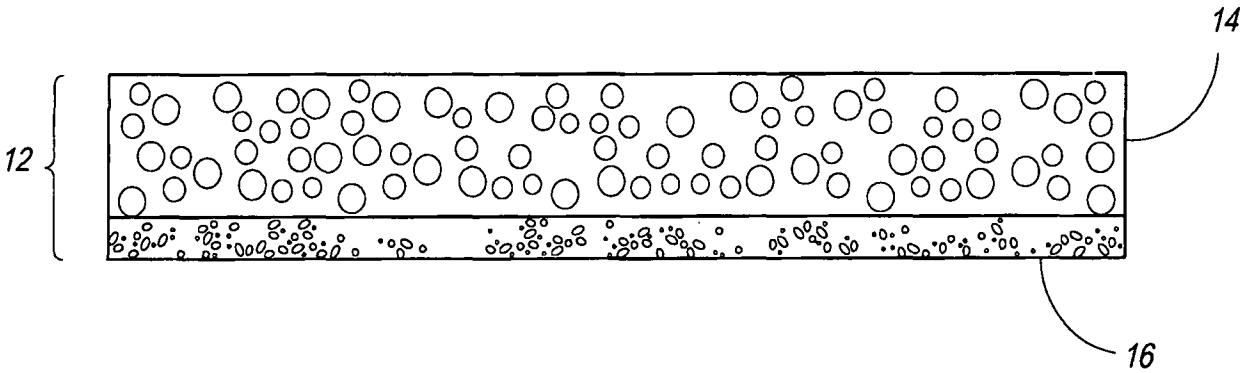
FIG. 11 is an illustrative method for providing liquid from within the reservoir to the multi-layered absorbent pad according to an embodiment.

Referring next to FIG. 11, methods for dispersing liquids from component 11 to component 12 are shown. According to example implementations, liquids can be dispersed from component 11 to component 12 by forcing flexible biased member 28 to an anti-biased position within component 11, substantially increasing pressure within component 11. The increased pressure within component 11 can provide enough force to within the reservoir to at least partially open slits 24. When slits 24 are at least partially open, the liquid from within component 11 can flow from the reservoir to component 12. Liquid forced from component 11 can flow first to component 14 of component 12. Component 14 can be configured as a substantially rigid, highly porous, and/or substantially thick material that readily disperses the liquids from component 11 throughout a majority of component 14. At least a portion of the liquid from within component 14 can then flow to component 16 of component 12. A portion of the liquid can remain within component 14 as another portion of the liquid flows to component 16. Component 16 can be configured as a less rigid, less porous, and/or thinner layer than component 14 and can readily absorb and retain liquids received from component 14. Additionally, component 16 can be configured to have a lesser rate of dispersion than component 14, which can allow component 16 to store liquids more readily than component 14. Both components 14 and 16 can be configured to be compressible, but component 16 can be configured to be substantially more compressible than component 14. According to example implementations, the compressibility and/or permeability of component 16 can allow liquids retained by component 16 to be expelled from component 16 when adequate external pressure is applied to component 16.

Figure 12:
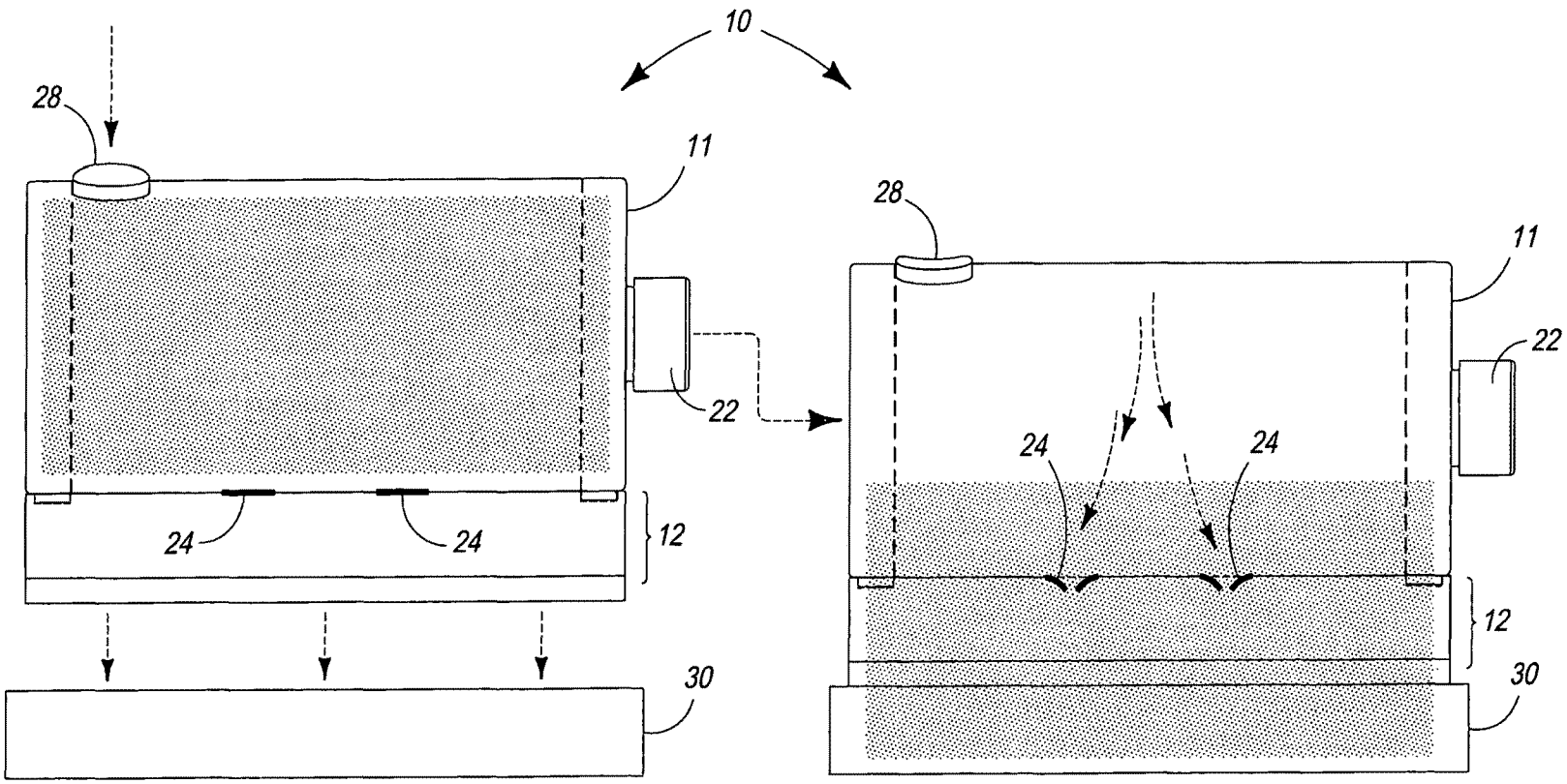
FIG. 12 is an illustrative method for receiving at least a portion of the multi-layered absorbent pad to within a storage vessel according to an embodiment.
Figure 11:
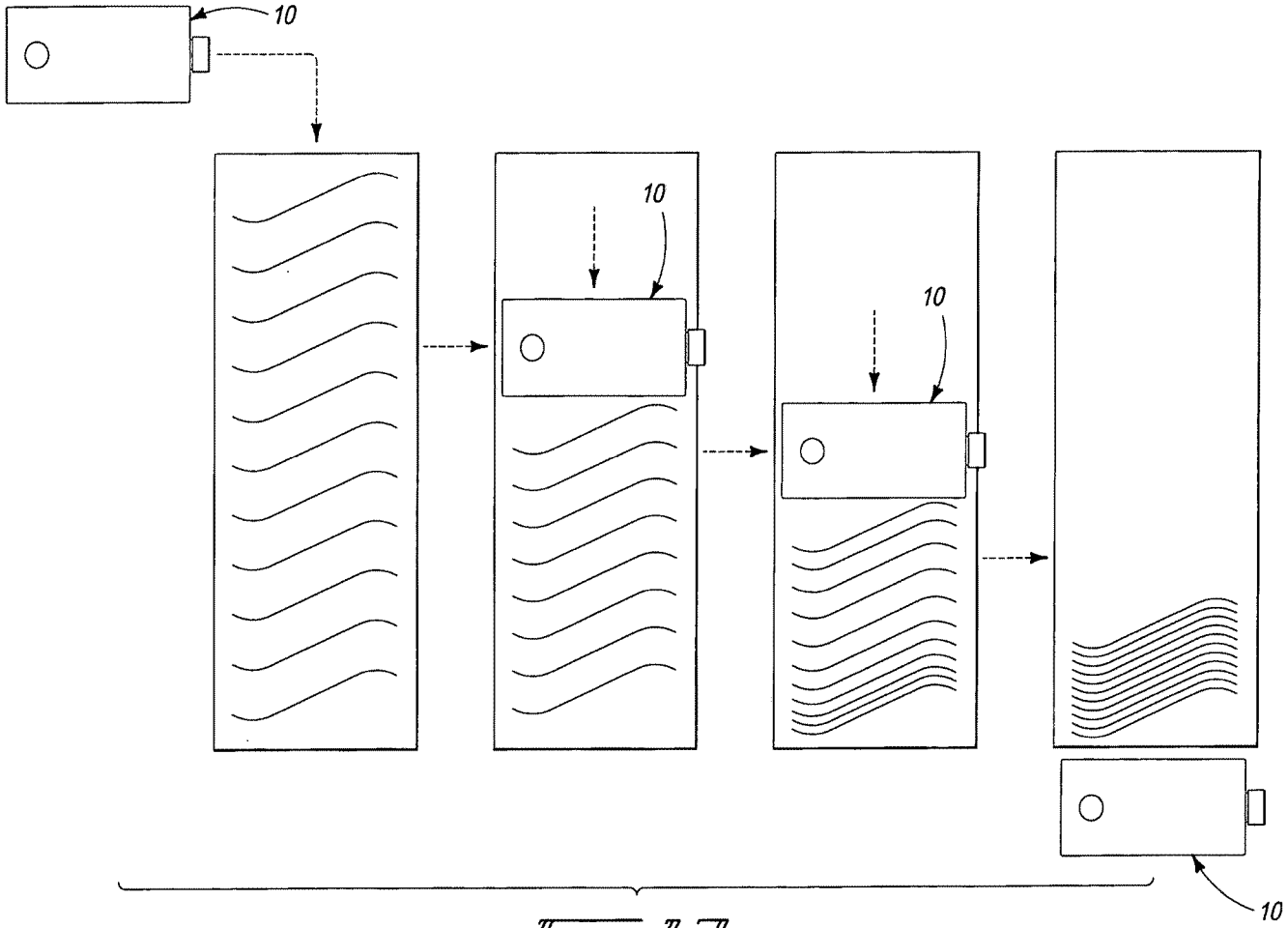

Referring next to FIG. 12, methods for apparatus 10 being received by vessel 30 are shown. Component 11 can be attached to component 12 and component 11 can be filled with cleaning solution. Component 12 can have retained liquids within it or be substantially dry. At least a portion of component 12 and/or component 11 can be received to within vessel 30, vessel 30 providing storage for apparatus 10 when not in use. Where component 12 has retained liquids within it, vessel 30 can provide a moist environment for component 12 and hinder the same from drying. By keeping component 12 damp, cleaning and/or hair gathering can be accomplished without dispensing more liquid from within component 11, thereby reducing wasted liquid and increasing the efficiency of the apparatus for cleaning and/or hair gathering.

Referring next to FIG. 13, methods for cleaning are shown. Apparatus 10 including, for example, component 16 can be placed upon materials to be cleaned and pressure can be applied to those materials. The applied pressure can compress component 16 and force retained liquids from within component 16 to materials to be cleaned. When a desired amount of liquid has been applied to materials to be cleaned, pressure on those materials can be released and the liquid absorbed back into component 16 as it retracts and decompresses.

Alternatively, component 16, having retained liquids, can be swiped across materials to be cleaned, leaving the materials at least partially damp. This method of cleaning can allow liquids from component 16 to remain on materials to be cleaned for a greater period of time, allowing the liquids to react with stains on materials to be cleaned. Once a desired amount of time has passed, component 16 can be swiped back across the materials to be cleaned. The absorbent nature of component 16 can absorb the liquids from the cleaned materials to component 16 to be disposed of.

Additionally, FIG. 13 illustrates at least one method for the gathering of hair. Component 16, having retained liquids from component 11, can be swiped across materials to remove hair. Component 16 can substantially attract hair from materials by providing greater friction between component 16 and the hair than between the hair and the materials to be cleaned. The liquid retained within component 16 can be released from component 16 to the hair on materials to be cleaned when component 16 is swiped across the surface of the materials to be cleaned. The transferred liquid on the hair can substantially hinder expulsion of the hair from the materials to be cleaned into the surrounding air. The dampness of the hair and the friction created between the hair and component 16 can allow hair to be gathered together when component 16 is swiped across materials to be cleaned. The gathered hair can then be disposed of without it being expelled into the surrounding air for example. Any hair that may have stuck to component 16 during the gathering process may be removed by the operator and component 16 can be used again for gathering hair.

Figure 14:
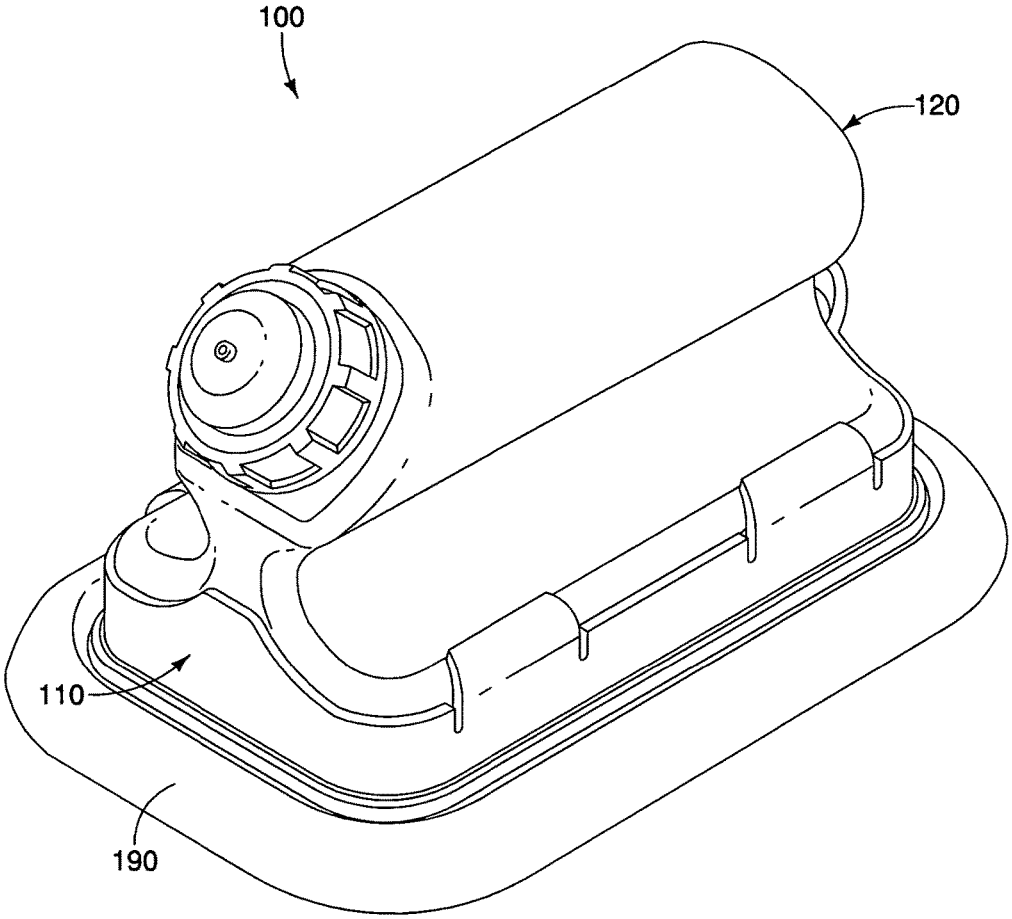
FIG. 14 is an isometric drawing of another version of the pet hair removal apparatus provided for herein.

Another embodiment of the pet-hair removal apparatus provided for herein is depicted in FIGS. 14-23E. The pet-hair removal apparatus 100 of this additional embodiment is depicted in FIG. 14 in an isometric view. The apparatus 100 includes a fluid reservoir assembly 120 and a hair-removal pad support assembly 110, and can also include a support tray 190. As described more fully below, the hair-removal pad support assembly 110 is configured to be detachable from the fluid reservoir assembly 120 so that hair removal pads (described below) can be replaced should they become worn or otherwise lose effectiveness in their ability to facilitate in the removal of pet hair and the like from furniture, carpets, etc. The support tray 190 includes a fluid-impermeable base and sidewall (not numbered, but shown in FIG. 22) which allows the apparatus 100 to be stored such that any fluid leakage from the pet hair removal outer pad (186, described below) is contained, and further to facilitate in reduction of fluid evaporation from the pet hair removal outer pad 186, and in keeping the hair removal pad clean, between uses of the apparatus 100.

Figure 15:
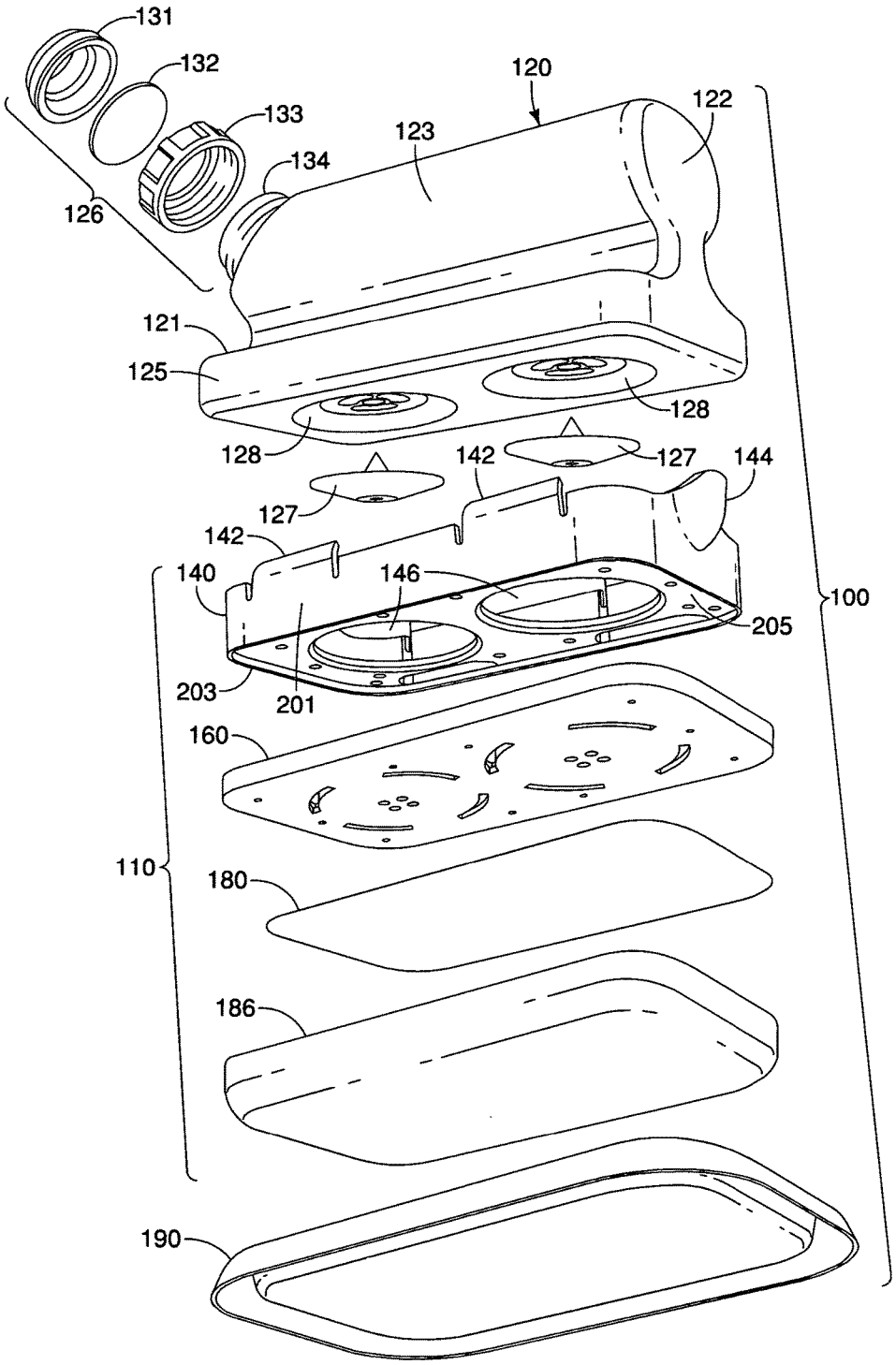
FIG. 15 is an exploded view of the apparatus of FIG. 14.

FIG. 15 is an exploded view of the apparatus 100 of FIG. 14. The apparatus 100 includes the fluid reservoir assembly 120, the hair-removal pad support assembly 110, and the storage tray 190. The fluid reservoir assembly 120 includes a hollow fluid reservoir body 122 having a fluid reservoir body upper portion 123 that is formed to allow a user to grip and hold the fluid reservoir body 122. The fluid reservoir body 122 also includes a fluid reservoir body lower portion 125 that has fluid outlet openings 128 formed in the bottom thereof. The fluid reservoir body 122 defines a fluid reservoir (271, depicted in the cross-sectional view of FIG. 22, described below). The fluid reservoir 271 of FIG. 22 can be considered as a generally closed fluid reservoir, with fluid within the reservoir generally including (in use) a liquid and a vapor above the liquid. The generally-closed nature of the fluid reservoir 271 is achieved by one or more valves 127 (described below) which permit liquid to exit the fluid reservoir via the valve(s) 127 only when pressure within the reservoir is increased beyond ambient pressure, and by a pump device 126 (also described below) which allows ambient air to be introduced into the reservoir during use and following activation of the pump device. (It will be appreciated that the generally-closed nature of the fluid reservoir 271 can be defeated by removing the collar 133 (described below) of the pump device 126, which can be performed in order to fill the fluid reservoir 271 with liquid, but such a configuration—i.e., removal of collar 133—does not represent an in-use status of the apparatus 100.) That is, generally-closed, as used herein with respect to reservoir 271, refers to an intended use-status of the apparatus 100.)

The fluid reservoir assembly 120 further includes one or more unidirectional fluid outlet valves 127 that allow fluid contained within the fluid reservoir body 122 to exit the fluid reservoir body 122 when pressure within the fluid reservoir body exceeds ambient pressure (as described more fully below).

The unidirectional valves 127 depicted in FIG. 15 can be described as umbrella valves due to their appearance resembling an upside-down umbrella. The unidirectional valves 127 are preferably circular in shape such that liquids forced through the valves are evenly distributed about the outer perimeter of the valves. Further, the unidirectional valves 127 preferably cover about 10% or more of the lower surface area of the fluid reservoir body lower portion 125 so that liquid exiting from the valves is distributed over a large portion of the underside of the fluid reservoir body lower portion 125. The unidirectional valves 127 are preferably fabricated from a flexible, resilient material such as rubber or a soft plastic. While FIG. 15 depicts two unidirectional valves 127 being provided, less preferably the fluid reservoir assembly 120 can include only a single unidirectional valve, or the fluid reservoir assembly 120 can include three or more unidirectional valves. More preferably, the one or more unidirectional valves 127 are generally centrally located in the bottom of the fluid reservoir body lower portion 125 to facilitate a non-localized distribution of liquid emanating from the valves to the hair-removal pad support assembly 110. (The generally central location of the unidirectional valves 127, in conjunction with the positioning of fluid openings in a pad support body (140) and a pad support base (160), as described more fully herein below, allows for a wide, non-localized, distribution of fluid emanating from the valves 127 to the per hair removal pad 186 (also described below). The term "generally centrally located" with respect to the location of the unidirectional valves 127 within the bottom of the fluid reservoir body lower portion 125 is used herein to indicate that a mounting point for at least one of such valves is located nearer the middle of the bottom of the fluid reservoir body lower portion 125 than to a periphery of the fluid reservoir body lower portion.) However, it will be appreciated that a series of unidirectional valve 127 can be located in various positions across the bottom of the fluid reservoir body lower portion 125 in order to achieve a wide distribution of liquid emanating from the valves to the underlying hair-removal pad support assembly 110.

The fluid reservoir assembly 120 further includes a pump device 126 that is used to pressurize the fluid reservoir formed within the fluid reservoir body 122. In the example depicted in FIG. 15, the pump device 126 is a bidirectional pump having a flexible pump actuator 131, a diaphragm 132, and a securing collar 133. The flexible pump actuator 131 is inserted through, and retained by, the collar 133, and the diaphragm 132 is then placed against the lower portion of the pump actuator 131. The collar is then screwed onto (or otherwise secured to) the fluid reservoir fill neck 134. (It will be noted that FIG. 15 does not show the assembly order for components of the pump device 126 in order to avoid confusion as to the final assembled order of the components.) In operation, a user pushes down on the flexible pump actuator 131, thus forcing the diaphragm 132 to be displaced downward into the fill neck 134, thus pressurizing fluids (liquids and gasses) within the reservoir defined by the fluid reservoir body 122. As a result of this pressurization of contents within the fluid reservoir, liquid is force out through the unidirectional valves 127. Once the user releases the pump actuator 131 ambient air can flow into the fluid reservoir of the reservoir body 122, such that a vacuum is not formed inside of the reservoir. In the configuration depicted in FIG. 15 the flexible pump actuator 131 can be fabricated from a pliable, resilient material such as rubber, and the diaphragm 132 can be fabricated from a pliable, resilient material such as a soft plastic or rubber.

The hair-removal pad support assembly 110 of the apparatus 100 of FIG. 15 can include a pad support body 140, a pad support base 160, an inner pad 180, and an outer pad 186. The outer pad 186 is intended to be the portion of the apparatus 100 which acts to remove pet hair and the like from articles such as upholstered furniture, carpets, etc. The outer pad 186 is preferably fabricated from a textured flexible fluid permeable material, such as (and preferably) a polyvinyl alcohol (or PVA) cloth. PVA cloth is available in differing forms (e.g., as a synthetic chamois), and is known for its highly absorbent properties, durability, and the soft texture when moist. When wetted by liquid from the reservoir body 122 (as described in more detail below), the outer pad (or cloth) 186 can be moved over an article to be cleaned (such as seat cushions or the like) and will gather and remove matter (such as pet hair and the like) from the article, while not leaving behind undesirable quantities of the liquid. The outer pad 186 is preferably between about 1-2 mm thick. The installation of the outer pad 186 with the other components of the hair-removal pad support assembly 110 will be described below.

As depicted in FIG. 15, in addition to outer pad 186 the hair-removal pad support assembly 110 preferably also includes an inner pad 180. The inner pad 180 rests against the upper surface of the outer pad 186. (Inner pad 180 and outer pad 186 are supported in an essentially fixed position against the bottom of pad support base 160, as described more fully below.) The inner pad 180 is preferably fabricated from a high-permeability material, such as for example polyester mesh. The inner pad 180 is preferably between about 2 mm and 6 mm in thickness, and serves two primary functions. Firstly, the inner pad 180 provides a resilient cushion for the outer pad 186 so that the outer pad can flex, thus allowing the outer pad to better contact the surface that the outer pad is being moved across during use of the apparatus 100. Secondly, the inner pad provides a fluid distribution network to facilitate in spreading fluid (from the fluid reservoir body 122) to the outer pad 186.

The hair-removal pad support assembly 110 of FIG. 15 also includes a pad support body 140 and a pad support base 160. As indicated above, the pad support base 160 serves to provide support for the flexible inner and outer pads 180, 186. The pad support base 160 preferably connects to the pad support body 140 in an essentially non-removable manner, with a perimeter edge of the outer pad 186 trapped between the lower perimeter of the pad support body 140 and a perimeter groove in the upper perimeter of the pad support base 160 (as shown in figures described below). In this way the pad support body 140, the pad support base 160, and the inner and outer pads (180, 186) become an integral assembly. Since the pad support body 140 is configured to be attached to the fluid reservoir assembly 120 in a removable manner (as described below), the user can replace the outer pad 186 (should it become torn, worn or fouled) by removing the hair-removal pad support assembly 110 and installing a new unit. The removable nature of the hair-removal pad support assembly 110 also allows the user to soak the outer pad 186 in a cleaning solution or otherwise clean the outer pad without interference from the fluid reservoir assembly 120. The pad support assembly 110 is preferably constructed into an essentially unified integral assembly such that the components of the pad support assembly (i.e., pad support body 140, pad support base 160, inner pad 180, and outer pad 186) cannot disassembled from one another other than by destructive deconstruction means and methods which do not allow for subsequent reassembly of the components of the pad support assembly 110 following such disassembly of the pad support assembly 110 without replacing one or more constituent component parts of the original pad support assembly 110 with a new component part of the pad support assembly 110. That is, preferably disassembly of the pad support assembly 110 cannot be performed in a manner which allows the disassembled original components of the pad support assembly 110 to be reassembled other than by reconstructing (or replacing) one or more of the original components.

The pad support body 140 includes a continuous perimeter wall 201 which is preferably formed in a rectangular arrangement in plan view, and which defines a pad support body lower perimeter edge 203. The pad support body 140 further includes a pad support body bottom member 205. The pad support body bottom member 205 is preferably recessed within the perimeter wall 201 by a distance of between about 1-4 mm from the pad support body lower perimeter edge 203 such that the lower perimeter edge 203 of perimeter wall 201 forms and defines a flange, or lip, which is configured to be received within a perimeter groove of the pad support base 160. (Alternatively to the lower lip or flange 203 of the pad support body 140 being received within a groove in the pad support base 160, the lower lip 203 can be receiving inside of an outer flange 253, FIG. 18, of the pad support base, as described below.) While the lip 203 is depicted in FIG. 15 as being continuous about the lower periphery of the pad support body 140, this is not a requirement.

The pad support body 140 includes one or more mounting clips 142 located at the upper edge of the body 140 (two such clips 142 are depicted in FIG. 15). The mounting clips 142 are configured to engage an upper edge 121 of the reservoir body lower portion 125, and thus hold the hair-removal pad support assembly 110 and the fluid reservoir assembly 120 together in a releasable manner. More specifically, the one or more mounting clips 142 are preferably configured as spring-biased clips, such that an outward force on the clips will allow them to release the hair-removal pad support assembly 110 from the fluid reservoir assembly 120. The pad support body 140 can be fabricated from a semi-rigid resilient material (such as plastic or nylon), and in this manner the mounting clips 142 can provide the necessary flexibility to allow them to be moved over, and away from, the upper edge 121 of the reservoir body lower portion 125, thus allowing the pad support body 140 to be easily connected to, and removed from, the fluid reservoir assembly 120. The pad support body 140 can further include a finger engagement feature 144 which is located proximate of, and outward from, the upper perimeter edge of the pad support body. The finger engagement feature 144 can be used by a user to force the pad support assembly 110 away from the fluid reservoir assembly 120. By applying a downward force on the finger engagement feature 144, the mounting clips 142 will be caused to separate from the upper edge 121 of the reservoir body lower portion 125. More specifically, when the reservoir body lower portion 125 and the pad support body 140 are arranged in a complimentary non-square rectangular shape and orientation (as depicted in FIG. 15), and with the mounting clips 142 provided along a long-edge of a rectangle defining the plan-view shape of the apparatus 100, the finger engagement feature 144 is located at a short-end of the rectangular arrangement in order to provide enhanced leverage to force the mounting clips 142 away from the upper edge 121 of the reservoir body lower portion 125.

The pad support body 140 further defines pad support body fluid openings 146, which are located proximate the unidirectional valves 127 (when the pad support body is joined to the fluid reservoir assembly 120). The pad support body 140 defines fluid openings 146 which allow liquid passing from the unidirectional valves 127 to pass through the pad support body 140 and to the pad support base 160, and thence to the inner pad (180) and the outer pad (186), as described more fully below.

Figure 16:
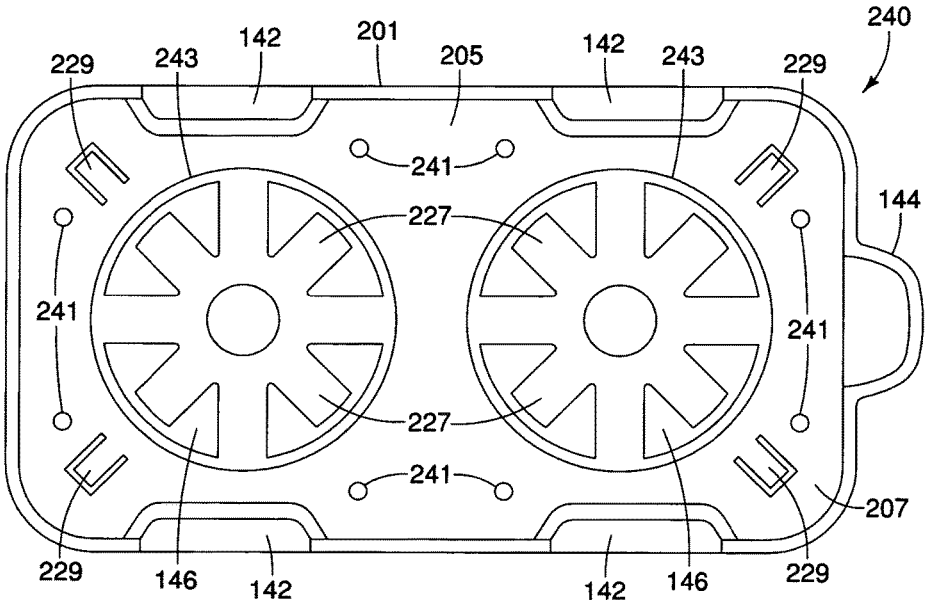
FIG. 16 is a plan view of an alternative version of the pad support body 140 depicted in FIG. 15.
Figure 17:
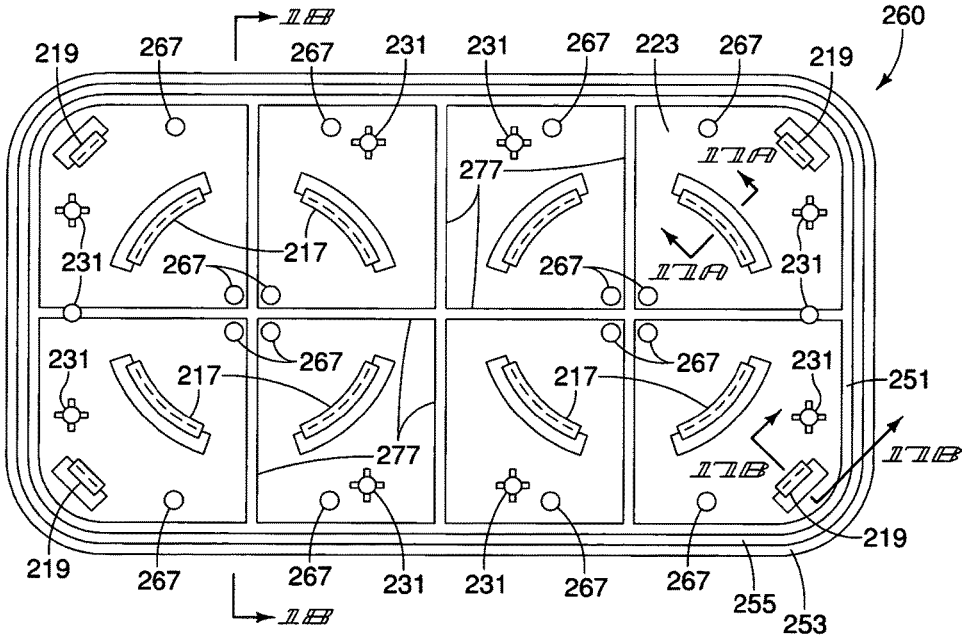
FIG. 17 is a plan view of an alternative version of the pad support base 160 depicted in FIG. 15.
Figure 17A:
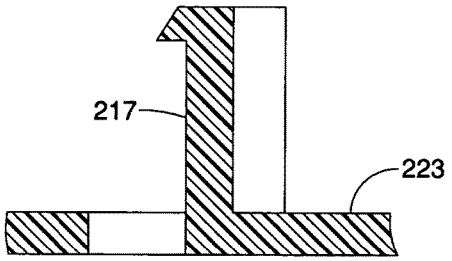
FIG. 17A is a cross section of a perimeter clip member attached to the pad support base depicted in FIG. 17.
Figure 17B:
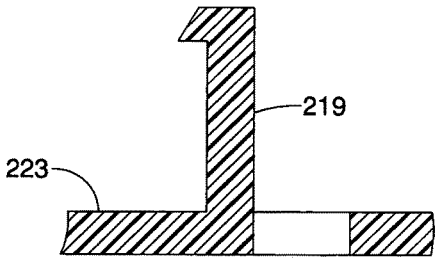
FIG. 17B is a cross section of a valve-opening clip member attached to the pad support base depicted in FIG. 17.
Figure 18:
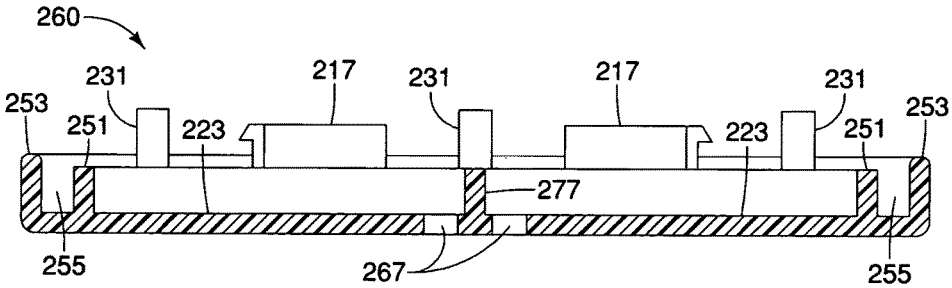
FIG. 18 is an end-view cross section of the pad support base depicted in FIG. 17.

A preferred arrangement and variation of the pad support body 140 and pad support base 160 of FIG. 15 is depicted in FIGS. 16, 17, and as otherwise described herein. Specifically: (i) FIG. 16 is a plan view of an alternative configuration 240 of the pad support body 140 depicted in FIG. 15; (ii) FIG. 17 is a plan view of an alternative configuration 260 of the pad support base 160 depicted in FIG. 15; (iii) FIG. 18 is a cross-section of the alternative pad support base 260; (iv) FIG. 17A is a cross-section of a valve-opening clip 217; and (v) FIG. 17B is a cross-section of a perimeter clip 219. Referring to plan view FIG. 16 of alternative pad support body 240, the pad support body 240 includes the following components and features: perimeter wall 201; bottom member 207 (similar to bottom member 205 described above with respect to FIG. 15); perimeter clip receivers 229; valve-opening clip receivers 227; and alignment-post openings 241. Ridge feature 243 is a ridge elevated above bottom member 207 and valve-opening clip receivers 227, and provides structural rigidity for the clip receivers 227.

With respect to FIG. 17 (a plan view of an alternative configuration 260 of the pad support base 160 depicted in FIG. 15), the pad support base 260 includes the following components and features: (i) a pad support base platform 223; (ii) a plurality of perimeter clip arms (perimeter clip members, or perimeter clips) 219 which are configured to engage with the perimeter clip receivers 229 depicted in FIG. 16; (iii) a plurality of valve-opening clip arms 217 (valve-opening clip members, or valve-opening clips) which are configured to engage with the valve-opening clip receivers 227 of FIG. 16; (iv) a plurality of upward-projecting alignment-posts 231; and (v) a plurality of pad support base fluid openings 267 which allow fluid emanating from unidirectional valves 127 to be distributed from fluid openings 146 in the pad support base (240, FIG. 16) to the underlying inner pad 180 and the outer pad 186. (Pad support base fluid openings 267 can be located in the pad support base 260 either centrally, peripherally, a combination thereof, or otherwise in order to provide a generally even distribution of liquid emanating from the unidirectional valve(s) 127 (FIG. 15) to the underlying outer pad 186. In one configuration the pad support base fluid openings 267 are generally centrally located within the valve-opening clip members 217, and liquid emanating from these generally centrally located pad support base fluid openings 267 then migrates to peripheral portions of the outer pad 186 by capillary action and other fluid dynamic forces which cause a liquid to migrate from a more wetted area to a lesser wetted area. In the instance of providing liquid to a generally centrally located area of the pad support base 260, a wiping action by the user in moving the apparatus 100 across a surface to be cleaned will further facilitate migration of the liquid from a generally central portion of the outer cleaning pad 186 to peripheral portions of the pad 186.) The pad support base 260 of FIG. 17 can further include structural members 277 which rise from the pad support platform 223, and which can in aid in providing resistance to bending and torsional forces imposed on the pad support base.

Upward-projecting alignment posts 231 of pad support base 260 depicted in FIG. 17 fit into alignment holes 241 in pad support body 240 (FIG. 16) to thus guide the pad support base onto the body. When alignment-posts 231 are made of a material such as plastic or the like, and protrude from alignment holes 241, then the alignment pins can also act as weld-members (by thermal or ultrasonic welding) to assist in securing the pad support base 260 to the pad support body 240. It will be appreciated that the alignment posts 231 can also, and alternatively, be provided on the pad support body 240, with the alignment post holes 241 being provided on the pad support base 260, as well as combinations thereof (i.e., some alignment posts 231 can be provided on both pad body 240 and pad base 260, with corresponding alignment post holes 241 being provided in complimentary positions on the pad body and pad base). Thus, the hair-removal pad support assembly 110 generally provides for alignment posts (e.g., 231) and complimentary alignment post holes (e.g., 241) to be provided in the pad support body 240 and the pad support base 260 in order to allow the pad support body and pad support body to be brought together in a mated relationship with one another in correct alignment. In addition to, or alternatively to, acting as weld-members to assist in securing the pad support base 260 to the pad support body 240, the alignment posts 231 can be fitted at the top thereof with a clip-feature (not shown) such that when the top-end clip-feature exits an alignment hole 241 the top-end clip-feature captures the clip-feature within the alignment hole such that the associated alignment post 231 cannot be pulled free of the alignment hole 241.

The pad support body 140 of FIG. 15 additionally includes a plurality of pad body clip engaging members that are configured to engage with pad base clip members in order to secured the pad support body 140 to the pad support base 160 in an essentially non-removable manner. One example of this arrangement is depicted in FIGS. 16 and 17 with respect to alternate pad support body 240 and alternate pad support base 260. As depicted in FIG. 17, pad support base 260 includes perimeter clip members 219 and valve-opening clip members 217. Perimeter clip members 219 are preferably located proximate the corners of the pad support base 260. FIG. 17B is a cross section of one perimeter clip member 219. When the pad support base 260 and the pad the pad support body 240 are brought together, the upper flange of perimeter clip members 219 (not numbered, but shown in the cross section of FIG. 176) move past the perimeter clip receivers 229 (FIG. 16) and the perimeter clip receivers 229 flex upward to allow the flange of the clip members 219 to move past the clip receivers 229. Once the flange of the clip members 219 moves past the clip receivers 229, the clip receivers (which can be fabricated from a resilient material such as plastic or the like) move back downward to their original positions, thus securing the clip members 219 of the pad support base 260 in the pad support body 240. Valve-opening clip members 217 are attached to the pad support base platform 223 and are disposed in circular arrangements which correspond to the periphery of the valve openings 146 in the pad support body 240 (FIG. 16). As depicted in FIG. 17, four valve-opening clips 217 are provided for each of the valve openings 146 in the pad support body 240. Preferably, the pad support base 260 includes at least two valve-opening clips 217 corresponding to each valve opening 146 in the pad support body 240. FIG. 17A is a cross section of one valve-opening clip member 217. When the pad support base 260 and the pad the pad support body 240 are brought together, the upper flange of valve-opening clip members 217 (not numbered, but shown in the cross section of FIG. 17A) move past the valve-opening clip receivers 227 (FIG. 16) and the valve-opening clip receivers 227 flex upward to allow the flange of the clip members 217 to move past the clip receivers 227. Once the flange of the clip members 217 moves past the clip receivers 227, the clip receivers (which are fabricated from a resilient material such as plastic of the like) move back downward to their original positions, thus securing the clip members 217 of the pad support base 260 in the pad support body 240.

As described above, pad support body (140, 240) can be joined together with pad support base (160, 260) in a generally non-removable manner by the way of clips and corresponding clip receivers formed in the pad support body and pad support base. However, clips (i.e., clip members) and interacting clip receivers can exhibit play (i.e., a degree of freedom of motion) there-between either after immediate engagement with one another, or over a period of time as a result of wear. It is preferable that the pad support body (140, 240) be joined together with pad support base (160, 260) in a manner which prohibits any degree of freedom of motion there-between. Accordingly, the pad support body (140, 240) and the pad support base (160, 260) are preferably joined to one another by a motion-restricting means (i.e., restricting any relative motion there-between during use and the like). Means for providing motion-restriction between the pad support body (140, 240) and the pad support base (160, 260) can include: (i) sonic and/or thermal welding (or other welding means) of one or more clip member (exemplarily described above) to one or more corresponding clip receiver (also exemplarily described above); (ii) sonic and/or thermal welding (or other welding means) of one or more alignment post (exemplarily described above) to a corresponding alignment post-hole (also exemplarily described above); (iii) the application of glue to one or more clip member (exemplarily described above) and one or more corresponding clip receiver (also exemplarily described above); (iv) the application of glue to one or more alignment post (exemplarily described above) to a corresponding alignment post-hole (also exemplarily described above); and (v) the application of glue, and/or welding means, to any surface of the pad support body (140, 240) which is in contact with the pad support base (160, 260).

Figure 19:
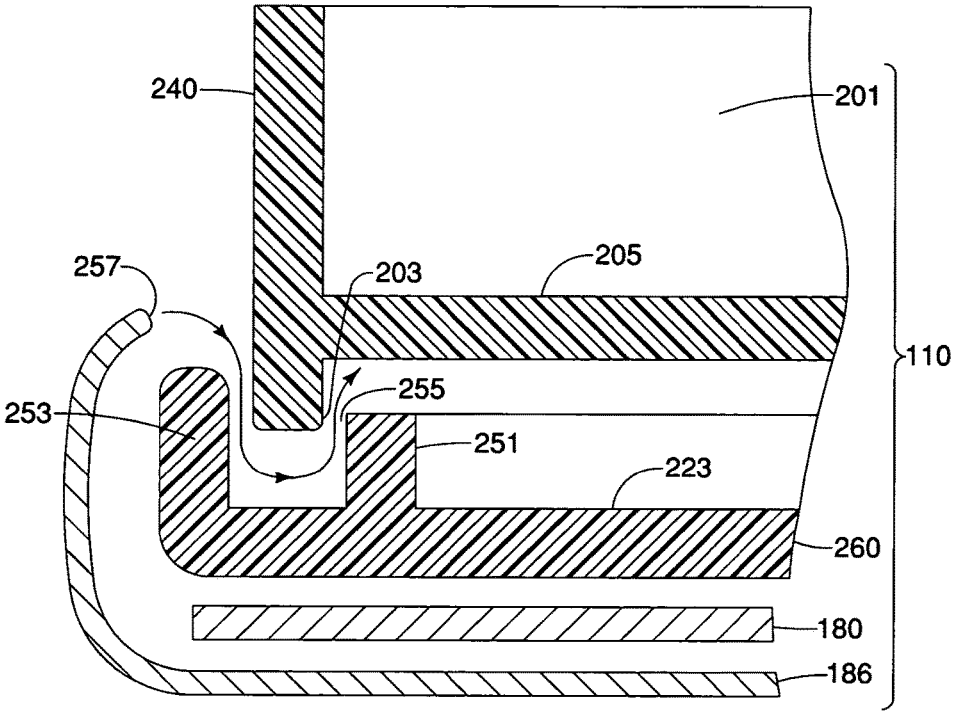
FIG. 19 is a partial end-view cross section, in exploded-view form, of the hair-removal pad support assembly and components depicted in FIG. 15, showing how the components of the hair-removal pad support assembly can fit together.
Figure 20:
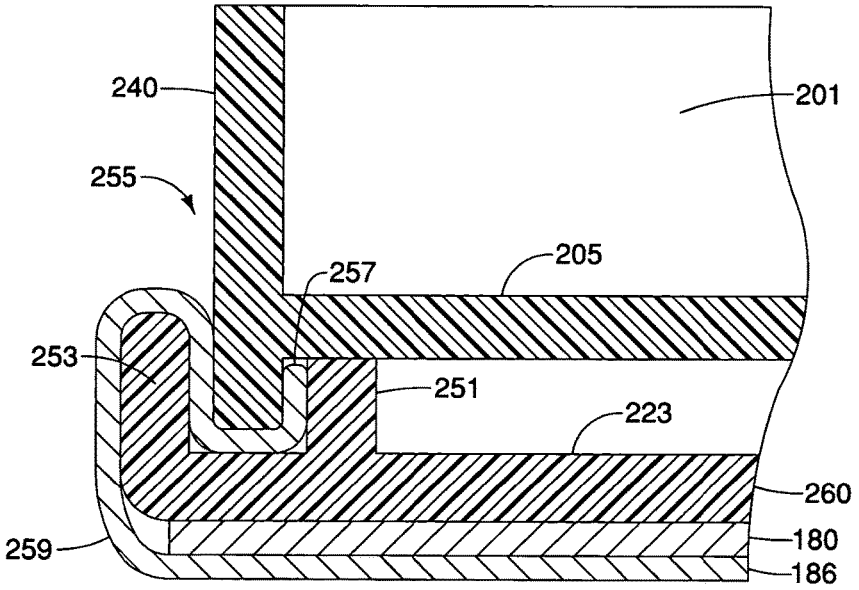
FIG. 20 is a partial end-view cross section, in assembled-view form, of the hair-removal pad support assembly and components depicted in FIG. 15, showing how the components of the hair-removal pad support assembly can appear after being fitted together.

As indicated above, after assembly of the hair-removal pad support assembly 110 (FIG. 15), the peripheral edge (257, FIGS. 19-21, described below) of the outer pad 186 is captured between the pad support body 140 and the pad support base 160 (or pad support body 240 of FIG. 16 and pad support base 260 of FIG. 17). This arrangement will now be more fully described with respect to FIGS. 18 through 21. FIG. 18 is a cross-section of the alternative pad support base 260. For the sake of simplicity, valve-opening clips 217 and perimeter clips 219 are not shown in the cross section of FIG. 18. The pad support base 260 includes an outer perimeter flange 253 and an inner perimeter flange 251, both of which rise vertically from the pad support base platform 223. Together, perimeter flanges 251 and 253 form a groove or channel 255 which runs around the periphery of the pad support base 260. Turning now to FIG. 19, a partial end sectional view of the hair-removal pad support assembly 110 (FIG. 15) is shown in an exploded view. As indicated by the directional arrows the outside edge 257 of the outer pad 186 is positioned in the groove 255 of the pad support base 260, with the inner pad 180 being positioned between the inner surface of the outer pad 186 and the bottom surface (not numbered) of the pad support base 260. (As used herein, the term outside edge 257 of outer pad 186 includes not only the actual edge of the outside pad 186, but also that area proximate to the actual edge, and preferably that area located within about 10 mm or less from the actual edge of the outside pad.) Further, in the assembly, the pad support body 240 is positioned above the pad support base 260 such that the lower perimeter lip 203 of the pad support body is directly above groove 255. FIG. 20 is an end sectional view of the pad support assembly 110 depicted in FIG. 19, but showing the components in the final assembled arrangement. As can be seen in FIG. 20, the edge 257 of the outer pad 186 is captured in the groove 255 of the pad support base 260 by the lower perimeter lip 203 (see FIG. 19) of the pad support body 240. The pad support body 240 and the pad support base 260 are held together by virtue of the clip members 217, 219 and respective clip receivers 227, 229 (FIGS. 16 and 17, described above), and/or by using alignment posts (231, FIG. 17) as weldment members and welding them to the pad support body 240 (as also described above). In this way the outer pad 186 is held in a fixed position within the pad support assembly 110. Further, as can be appreciated from FIG. 20, by wrapping the outer pad 186 around the outer perimeter flange 253 of the pad support base 260, the outer pad 186 covers not only the bottom surface of the pad support base 240, but also the sides of the pad support base. This feature has two direct benefits: (i) firstly, it eliminates any edges of the pad support base 260 from being exposed and thus potentially coming into contact with a surface to which outer pad 186 is being applied during use, which might otherwise cause damage by virtue of contact between an exposed edge of the rigid base 260 and the surface being cleaned; (ii) secondly, it provides for a cleaning edge 259 (FIG. 20) that can be used to access crevices and the like on the surface being cleaned by use of the apparatus. (It will be noted that in FIGS. 19 and 20 the pad support assembly 110 of FIG. 15 is indicated, but using the alternative pad support body 240 and the alternative pad support base 260 of FIGS. 16 and 17 (respectively), and not the pad support body 140 and pad support base 160 depicted in FIG. 15. For purposes of FIGS. 19 and 20, this interchange of components (pad support body 240 for pad support body 140, and pad support base 260 for pad support base 160) is indistinguishable.)

One advantage of the arrangement depicted in FIGS. 19 and 20 is that, during assembly, and particularly when joining the pad support body 240 to the pad support base with the edge areas 257 of the outer pad 186 captured between the pad support body 240 and the pad support base 260 by means of one or more outer perimeter flanges formed on the pad support body and/or the pad support base, the outer pad is drawn taught (i.e., captured in a tensioned manner) across a lower surface of the pad support base 260 (or across the lower surface of an inner pad 180 disposed between the inner surface of the outer pad 186 and the lower surface of the pad support base 260). This is preferably achieved by one of the configurations depicted in FIGS. 23A and 23B (described in detail below), wherein the pad support body 204 includes a downward-projecting lower lip or flange 203 which is positioned inward of an upward-projecting outer peripheral flange 253 formed on the pad support base 260. When the downward-projecting lower lip 203 and the upward-projecting outer peripheral flange 253 are vertically drawn towards one another (according to FIG. 19), with the outer edge area 257 of the outer pad 186 positioned there-between (and with the lower lip 203 being located inward of the outer flange 253), the outer edge area 257 of the outer pad 186 will be drawn into tension across the outer surface of the pad support base 240, as well as over the sides of the outer peripheral flange 253 formed on the pad support base 260.

Figure 23A:
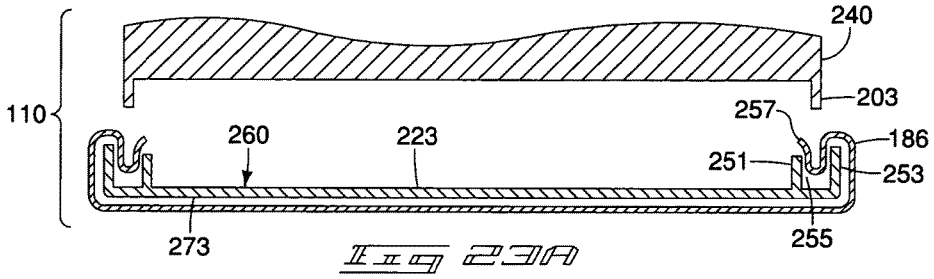
FIGS. 23A through 23E are end-sectional views depicting variations of the pad support assembly 110 of FIG. 15.
Figure 23B:
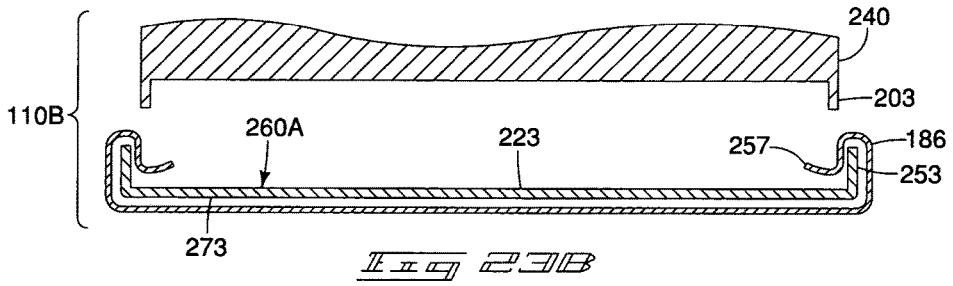

In one variation on the arrangement depicted in FIGS. 18-20, the pad support base 260 does not include the inner perimeter flange 251, and the outer edge 257 of the outer pad 186 is captured by compression between the lower perimeter lip 203 of the pad support body 240, the outer perimeter flange 253 of the pad support base 260, and the pad support base platform 223. This arrangement is depicted in FIG. 23B, which is described below.

Figure 21:
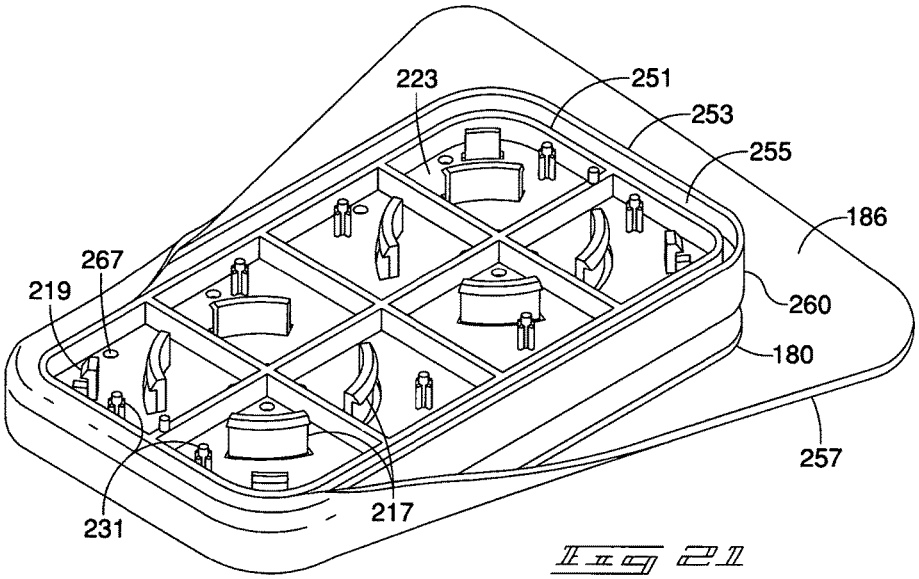
FIG. 21 is a isometric diagram depicting how the outer pad of the hair removal apparatus partially depicted in FIGS. 19 and 20 can be applied to the pad support base.

FIG. 21 is an isometric view of the pad support base 260 with the outer pad 186 partially pulled-away from engagement with the base 260, depicting how the outer edge 257 of the outer pad 186 fits within the grove 255 of the pad support base 260.

Figure 22:
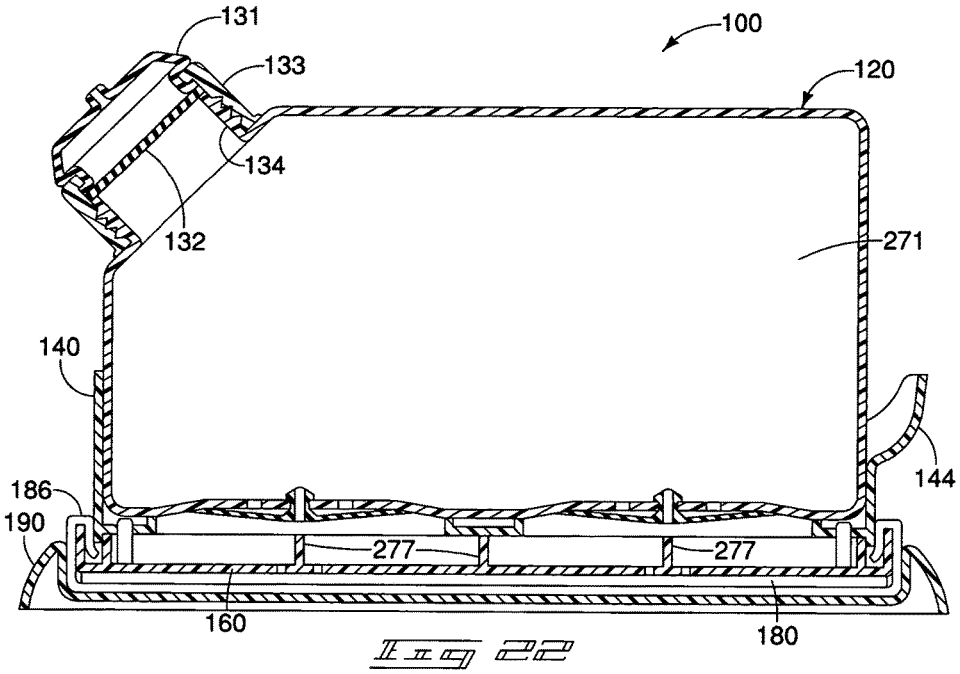
FIG. 22 is a side sectional view of the assembled pet hair removal apparatus depicted in exploded view in FIG. 14.

FIG. 22 is a cross sectional side view of the apparatus 100 of FIG. 14, depicting the apparatus in final assembled form and resting on the support tray 190.

As indicated above, a significant advantage of providing the hair-removal pad support assembly 110 as a detachable unit from the fluid reservoir assembly 120 (FIGS. 14 and 15) is that, should the outer pad 186 become worn, torn, fouled, or otherwise lose effectiveness in its ability to facilitate in the removal of pet hair and the like, the outer pad can be easily replaced by replacing the used pad support assembly 110 with a new unit. This removes the difficulty of replacing the outer pad 186 separately, which can present an undesirable challenge to the user in achieving the proper orientation and tensioning of the outer pad 186 with respect to the pad support base 160/260. One example of a prior-art pet hair removal apparatus is the "Fur Fighter" offered by 3M Corporation (St. Paul, Minn., US), which provides a unitary body having a grip and a lower surface covered by one part of a hook-and-loop fastening surface. Replaceable cleaning sheets (having a second part of the hook-and-loop fastening surface) can be applied to the lower surface of the "Fur Fighter" apparatus. However, as indicated on the packaging for the replacement sheets for the "Fur Fighter": "FAILURE TO COVER THE ENTIRE BOTTOM SURFACE OF THE HANDLE WITH THE MICROTRAP™ GRIPPER SHEETS COULD CAUSE DAMAGE TO UPHOLSTERY." (The use of all capitals in the proceeding quote are as per the original quote.) With the hair removal apparatus described herein, there is no such risk of damage to upholstery, as the user is not required to properly position a replacement pad (186) on the apparatus. The user merely has to replace an expended hair-removal pad support assembly 110 with a new unit (which includes a new cleaning pad 186 and the supporting body and base members (140, 240, and 160, 260, respectively), which requires no effort to achieve proper alignment of the new cleaning pad.

Figure 23C:
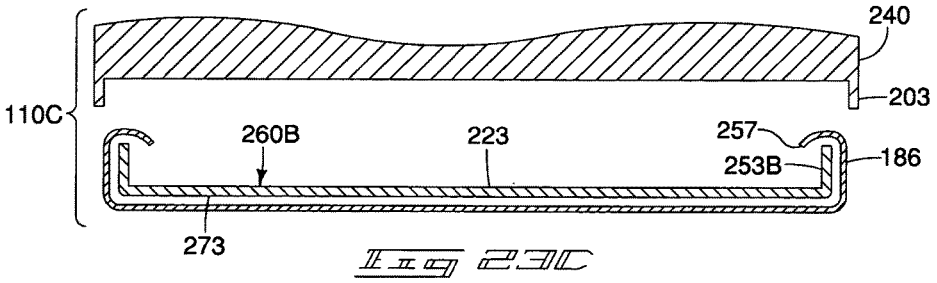
Figure 23D:
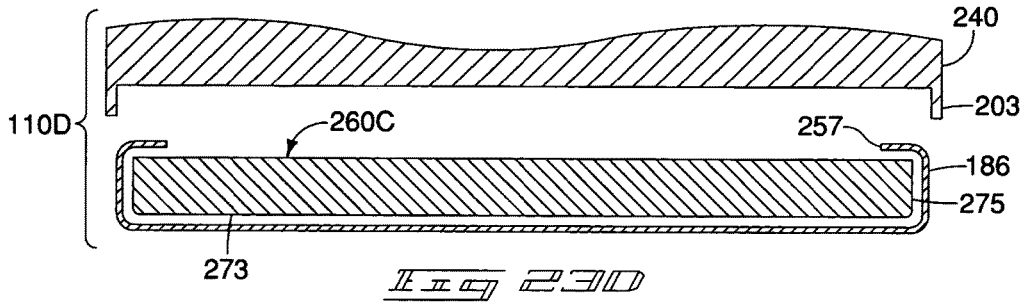
Figure 23E:
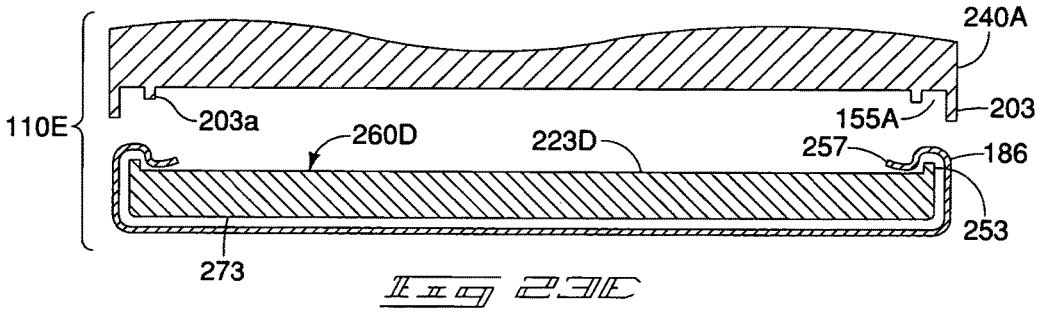

As indicted above, a meaningful feature of the pet hair removal apparatus 100 of the present disclosure which distinguishes the apparatus 100 (and variations thereof, as described and provided for herewithin) over prior pet-hair removal apparatuses is that the pet hair removal apparatus 100 (and variations disclosed and described herewithin) includes a replaceable pet hair removal cartridge (or pet hair-removal pad and support assembly, e.g., 110 of FIG. 15), and thus a used pet hair-removal pad support assembly (or cartridge 110) can be easily removed from the apparatus 100 and replaced with a new replacement cartridge 110. To this end, a number of different variations of the pet hair removal pad cartridge 110 of FIG. 15 can be provided for, and are depicted in FIGS. 23A through 23E as cartridges 110, and 110B through 110E. More specifically, FIG. 23A is an exploded sectional end view depicting a first variation of a pet hair removal pad cartridge 110, which is in accordance with FIG. 19 (described above). As indicated in FIG. 23A (and as also described above with respect to FIGS. 18-21), the pet hair removal pad cartridge 110 includes: (i) the pad support body 204 having lower lip 203; the pad support base 206 having respective inner and outer flange members 251 and 253 (which define groove 255); and wherein the outside area 257 of the outer pad 186 is captured within the groove 255 by the lower lip 203 of the pad support body 204. (It will be noted that in FIGS. 23A-23E the inner pad 180 (FIGS. 15 and 19, for example) is not shown, but it will be understood that the inner pad 180 can be included in any or all of the variations depicted in FIGS. 23A-23E.) FIG. 23B is an exploded sectional end view depicting a second variation of a pet hair removal pad cartridge 110B. The difference between the pet hair removal pad cartridge 110 depicted in FIG. 23A and the pet hair removal pad cartridge 110B depicted in FIG. 23B is that the pad support base 206A depicted in FIG. 23B does not include the inner flange 251, and thus no groove 255 is formed. Accordingly, in FIG. 23B the outer edge area 257 of the outer pad 186 is primarily secured between the pad support body 240 and the pad support base 260A by way of compression between of the pad support body lower lip 203 and the inner surface 223 of the pad support base 260A. FIG. 23C is an exploded sectional end view depicting a third variation of a pet hair removal pad cartridge 110C. In FIG. 23C the outer flange 253B of the pad support base 260B is positioned inward of the pad support body lower lip 203, and the outer edge area 257 of the outer pad 186 is captured between the pad support body 240 and the pad support base 260B by way of compressive and/or shear forces which will result by way of contact between the outer pad 186, the pad support body lip 203, and the pad support base outer flange 253B. FIG. 23D is an exploded sectional end view depicting a fourth variation of a pet hair removal pad cartridge 110D. In FIG. 23D the outer edge area 257 of the outer pad 186 is primarily captured by a shear force between an inside surface (not numbered) of the pad support body lower lip 203, and an outside end surface 275 of the pad support base 260C. (FIG. 23D is a less preferred arrangement, since assembly of the components as depicted will not naturally lend to tensioning of the outer pad 186 across the pad support base 260C.) FIG. 23E is an exploded sectional end view depicting a fifth variation of a pet hair removal pad cartridge 110E. In FIG. 23E the modified pad support body 240A is provided with an inward pad support body perimeter flange 203*a* (which is located inward from, and parallel to, the peripheral lip 203). Together, the inward pad support body perimeter flange 203*a* and the peripheral lip 203 of the pad support body 240A define a pad support body lower groove 155*a*. In FIG. 23E the pad support base 260D includes the outer peripheral flange 253 (as per pad support base 260, described above), and the edge-area 257 of the lower pad 186 is captured within the groove 155*a* by pad support base outer flange 253.

In all of FIGS. 23A through 23E it is understood that the pad support body 240 (and/or 240A) is securely fastened to the pad support base (260, 260B, 260C, and/or 260D, as alternatively depicted) in an immovable manner (as described above) in order to secure the outer pad 186 between the pad support body and the pad support base in a manner which does not allow the outer pad 186 to be easily moved away from the pad support base during use of the apparatus 100. That is, the arrangements depicted in FIGS. 23A through 23E preferably provide for the outer pad 186 to be held in a taught (i.e., tensioned) arrangement over the lower surface (273) of the pad support base (260, 260B, 260C, and/or 260D). (It is further understood that an inner pad 180, not shown in FIGS. 23A through 23E, but shown in FIG. 19) can be disposed between the outer pad 186 and the pad support base (260, 260B, 260C, and/or 260D).)

The apparatus 100 of FIG. 15 can thus be described as an apparatus for the removal of pet hair and the like from surfaces to be cleaned by the apparatus. The apparatus 100 includes a fluid reservoir assembly 120 and a cleaning pad cartridge assembly 110. The cleaning pad cartridge assembly 110 of the apparatus 100 is configured to be selectively removable from, and connectable to, the fluid reservoir assembly 120. The fluid reservoir assembly 120 includes a fluid reservoir body 122 which defines a closed fluid reservoir (271, FIG. 22, as described above) which can contain a fluid. The fluid reservoir assembly 120 includes a pump device 126 which can be used to pressurize the fluid reservoir 271, and one or more fluid outlet valves 127 which allow fluid (and in particular, liquid, under the influence of gravity and pressure within the fluid reservoir) to emanate from the fluid reservoir. The cleaning pad cartridge assembly 110 (and variations thereon, as per FIGS. 23A-23E) includes a cleaning pad support body (e.g., 140, 240), a cleaning pad support base (e.g., 160, 260), and a cleaning pad 186. The pad support body (140, 240) is configured to be joined together with the pad support base (160, 260) in an immovable manner, with an outer edge (257, FIGS. 19 & 20) of the cleaning pad 186 disposed between overlapping peripheral flanges of the pad support body and the pad support base. (An example of a peripheral flange of the pad support body 140, 240 is the lower lip 203 of pad support body 240 of FIG. 19; an example of a peripheral flange of the pad support base 160, 260 is the flange 253 depicted in FIG. 19). Preferably, the lower peripheral flange (e.g., 203, FIG. 19) of the pad support body (140, 240) is oriented inward of the upper peripheral flange (e.g., 253, FIG. 19) in order to draw the outer edges 257 of the cleaning pad 186 towards one another during mating of the pad support body (140, 240) and the pad support base (160, 260), and thus draw the cleaning pad 186 into tension across the bottom surface of the pad support base. (In the discussion above, a peripheral lip and/or flange can also be considered as a perimeter lip and/or flange.)

While the apparatus 100 has been described herein as a pet hair removal apparatus, it will be appreciated that any final use of the apparatus is irrelevant to the novel and non-obvious construction and features of the apparatus itself. The apparatuses described herein can generally be used to facilitate the removal of particles from surfaces (and preferably, textured surfaces), such surfaces including (but not limited to) clothing, carpets, upholstered furniture, and vehicle interiors. The particles that can be removed from surfaces by the apparatuses described herein can include not only pet hair, but also any solid substance which is not chemically bonded to an underlying surface.

The preceding description has been presented only to illustrate and describe exemplary methods and apparatus of the present invention. It is not intended to be exhaustive or to limit the disclosure to any precise form disclosed. Many modifications and variations are possible in light of the above teaching. It is intended that the scope of the invention be defined by the following claims.

We claim:

1. A pet hair removal apparatus, comprising:

a fluid reservoir assembly; and a hair-removal pad support assembly;

and wherein:

the fluid reservoir assembly and the hair-removal pad support assembly are configured to be selectively connected to, and removable from, one another;

the fluid reservoir assembly includes a hollow fluid reservoir body defining a fluid reservoir;

the fluid reservoir body includes a fluid reservoir body upper portion formed to allow a user to grip and hold the fluid reservoir body;

the fluid reservoir body further includes a fluid reservoir body lower portion which is contiguous with the fluid reservoir body upper portion, and which includes at least one fluid outlet opening formed in a bottom of the fluid reservoir body lower portion;

the fluid reservoir assembly further includes at least one unidirectional fluid outlet valve mounted proximate the at least one fluid outlet opening, and which allows fluid contained within the fluid reservoir body to exit the fluid reservoir via the at least one fluid outlet opening in the fluid reservoir body lower portion;

the fluid reservoir body further includes a pump device which allows a user to pressurize the fluid reservoir;

the hair-removal pad support assembly includes a pad support body, a pad support base, and an outer pad, and wherein:

the pad support body includes a lower perimeter lip;

the pad support base includes an outer flange and a pad support base platform;

the outer pad is defined by an outside edge area;

the lower perimeter lip of the pad support body is oriented inward of the outer flange of the pad support base; and the pad support body and the pad support base are joined together with the outside edge area of the outer pad being disposed between, and captured between, the lower perimeter lip of the pad support body and the pad support base platform.

2. The pet hair removal apparatus of claim 1, and wherein the hair-removal pad support assembly is fabricated as an integral assembly forming a cartridge.

3. The pet hair removal apparatus of claim 2, and wherein the pad support body and the pad support base are joined to one another by a plurality of clip members and clip receivers.

4. The pet hair removal apparatus 3 and wherein the clip members are supported by the pad support base, and the clip receivers are supported by the pad support body.

5. The pet hair removal apparatus of claim 2, and wherein the pad support body and the pad support base are mated to one another by a plurality of complimentary alignment posts and corresponding alignment holes respectively presented and defined on the pad support body and the pad support base.

6. The pet hair removal apparatus of claim 1, and wherein the pump device includes a directional air valve diaphragm configured to allow ambient air to enter the fluid reservoir following the user actuating the pump device.

7. The pet hair removal apparatus of claim 1, and wherein the at least one unidirectional fluid outlet valve is an umbrella valve allowing fluid to exit the fluid reservoir about a periphery of the umbrella valve.

8. The pet hair removal apparatus of claim 1 and wherein the fluid reservoir is formed as a closed fluid reservoir via the fluid reservoir body, the at least one unidirectional fluid outlet valve, and the pump device.

9. The pet hair removal apparatus of claim 1 and further including a motion-restricting means between the pad support body and the pad support base.

10. The pet hair removal apparatus of claim 9 and wherein the motion-restricting means between the pad support body and the pad support base includes at least one of: (i) a glue applied to one or more areas where the pad support body and the pad support base are in one or more of contact or proximity to one another; and (ii) a weld applied to one or more areas where the pad support body and the pad support base are in contact with one another.

11. A pet hair removal apparatus comprising:

a fluid reservoir assembly; and a cleaning pad cartridge assembly; and wherein:

the cleaning pad cartridge assembly is configured to be selectively removable from, and connectable to, the fluid reservoir assembly;

the fluid reservoir assembly includes a fluid reservoir body which defines a closed fluid reservoir which can contain a fluid, and wherein a portion of the fluid reservoir body is configured to be gripped by a user;

the fluid reservoir assembly includes a pump device which can pressurize the closed fluid reservoir, and at least one unidirectional fluid outlet valve which allows fluid to emanate from the fluid reservoir when the fluid reservoir is pressurized by the pump device;

the cleaning pad cartridge assembly includes a cleaning pad support body, a cleaning pad support base, and a cleaning pad; and wherein:

the cleaning pad support body is joined together with the cleaning pad support base in an immovable manner;

the cleaning pad is defined by an outer edge area;

the cleaning pad support body comprises a downward-projecting outer peripheral lip;

the cleaning pad support base comprises an upward-projecting outer peripheral flange;

the downward-projecting outer peripheral lip of the cleaning pad support body is oriented inward of the upward-projecting outer peripheral flange of the cleaning pad support base; and the outer edge area of the cleaning pad is positioned between the downward-projecting outer peripheral lip of the cleaning pad support body and the upward-projecting outer peripheral flange of the cleaning pad support base.

12. The pet hair removal apparatus of claim 11 and further comprising an inner pad which is disposed between an inner surface of the cleaning pad and a bottom surface of the cleaning pad support base.

13. The pet hair removal apparatus of claim 11 and wherein the cleaning pad support body and the cleaning pad support base define respective fluid openings which allow fluid which can emanate from the at least one unidirectional fluid outlet valve to migrate to the cleaning pad under the influence of gravity.

14. The pet hair removal apparatus of claim 11 and wherein the cleaning pad cartridge assembly further includes at least one mounting clip located proximate an upper edge of the cleaning pad support body, and which is configured to engage with a portion of the fluid reservoir body by way of the mounting clip having a resilient spring bias which is biased to favor the mounting clip engaging the fluid reservoir body, and allows a user to disengage the mounting clip by moving it against the spring bias.

15. The pet hard removal apparatus of claim 14 and wherein:

the reservoir body includes a lower portion which is defined by an upper edge; and the at least one mounting clip of the cleaning pad cartridge assembly is configured to engage the upper edge of the lower portion of the reservoir body.

16. The pet hair removal apparatus of claim 11 and wherein the cleaning pad support body and the cleaning pad support base each define fluid openings which allow liquid from the fluid reservoir to migrate to the cleaning pad when the at least unidirectional one fluid outlet valve is opened.

17. The pet hair removal apparatus of claim 11 and wherein the downward-projecting outer peripheral lip of the cleaning pad support body is continuous about the cleaning pad support body.

18. The pet hair removal apparatus of claim 11 and wherein:

the cleaning pad support base further comprises an upward-projecting inner peripheral flange;

the outer peripheral flange and the inner peripheral flange of the pad support base together define an outer groove around the pad support base; and the outer edge area of the cleaning pad is positioned within the outer groove of the pad support base, and the downward-projecting outer peripheral lip of the cleaning pad support body is at least partially disposed within the outer groove of the pad support base to thereby trap the outer edge area of the cleaning pad between the pad support base and the pad support body.

19. The pet hair removal apparatus of claim 11 and wherein the cleaning pad is fabricated from polyvinyl alcohol cloth.

20. The pet hair removal apparatus of claim 12 and wherein the inner pad is fabricated from a polyester mesh.

* * * * *